US010651599B2

(12) United States Patent
Hashiguchi

(10) Patent No.: US 10,651,599 B2
(45) Date of Patent: May 12, 2020

(54) CONNECTOR

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/502,355

(22) Filed: Jul. 3, 2019

(65) Prior Publication Data

US 2020/0083643 A1 Mar. 12, 2020

(30) Foreign Application Priority Data

Sep. 7, 2018 (JP) ..... 2018-167872

(51) Int. Cl.

| | |
|---|---|
| ***H01R 13/11*** | (2006.01) |
| ***H01R 13/631*** | (2006.01) |
| ***H01R 13/41*** | (2006.01) |
| ***H01R 12/71*** | (2011.01) |

(52) U.S. Cl.

CPC ..... *H01R 13/6315* (2013.01); *H01R 12/716* (2013.01); *H01R 13/11* (2013.01); *H01R 13/41* (2013.01)

(58) Field of Classification Search

CPC ..... H01R 13/6315; H01R 13/11; H01R 13/41

USPC ..... 439/246

See application file for complete search history.

(56) References Cited

U.S. PATENT DOCUMENTS

| | | | | |
|---|---|---|---|---|
| 6,250,935 | B1 * | 6/2001 | Mochizuki | H01R 13/658 439/74 |
| 6,692,266 | B2 * | 2/2004 | Hashiguchi | H01R 13/41 439/733.1 |
| 7,070,424 | B2 * | 7/2006 | Obikane | H01R 13/6471 439/74 |
| 7,172,434 | B2 * | 2/2007 | Obikane | H01R 24/60 439/570 |
| 7,497,697 | B2 * | 3/2009 | Hoshino | H01R 13/629 439/74 |
| 7,585,185 | B2 * | 9/2009 | Obikane | H01R 12/52 439/607.01 |

(Continued)

FOREIGN PATENT DOCUMENTS

| | | |
|---|---|---|
| JP | 2007-149477 A | 6/2007 |
| JP | 2014-225469 A | 12/2014 |
| JP | 2018-037151 A | 3/2018 |

*Primary Examiner* — Alexander Gilman

(74) *Attorney, Agent, or Firm* — Collard & Roe, P.C.

(57) ABSTRACT

A connector comprises a fixed housing, a movable housing and a plurality of contacts. The movable housing is accommodated in the fixed housing and is movable relative to the fixed housing. The movable housing has a catching portion. Each of the contacts has a resiliently deformable portion which is resiliently deformable. Each of the resiliently deformable portions is provided with a contact portion and a facing portion. Each of the facing portions is in contact with the catching portion or faces the catching portion at a distance apart therefrom in the width direction (X-direction). A movement of the movable housing relative to the fixed housing enables the facing portions to be pressed against the catching portion while allowing movements of the facing portions at least in the upper-lower direction (Z-direction).

15 Claims, 24 Drawing Sheets

(56) References Cited

U.S. PATENT DOCUMENTS 7,632,107 B2 * 12/2009 Mizumura ..... H01R 23/68 439/74
7,637,762 B2 * 12/2009 Uesaka ..... H01R 12/57 439/247
7,736,177 B2 * 6/2010 Tsai ..... H01R 12/57 439/570
8,348,701 B1 * 1/2013 Lan ..... H01R 12/707 439/607.19
8,986,027 B2 * 3/2015 Nishimura ..... H01R 12/707 439/181
9,039,428 B2 * 5/2015 Sasaki ..... H01R 12/716 439/74
9,124,011 B2 * 9/2015 Miyazaki ..... H01R 12/716
9,246,279 B2 * 1/2016 Kato ..... H01R 13/6596
9,391,398 B2 * 7/2016 Omodachi ..... H01R 12/707
9,728,882 B1 * 8/2017 Nakazawa ..... H01R 12/716
9,887,473 B2 * 2/2018 Lee ..... H01R 12/716
10,312,639 B2 * 6/2019 Chen ..... H01R 12/707
10,446,985 B2 * 10/2019 Ooi ..... H01R 13/6471
10,498,055 B2 * 12/2019 Chen ..... H01R 4/02
10,505,300 B2 * 12/2019 Chen ..... H01R 12/7005
2005/0032400 A1 * 2/2005 Zhang ..... H01R 13/41 439/74
2005/0032434 A1 * 2/2005 Zhang ..... H01R 12/716 439/660
2005/0042924 A1 * 2/2005 Zhang ..... H01R 13/6582 439/607.36
2005/0095881 A1 * 5/2005 Fan ..... H01R 12/716 439/74
2005/0277334 A1 * 12/2005 Huang ..... H01R 23/6873 439/607.01
2006/0040557 A1 * 2/2006 Yamaguchi ..... H01R 13/6583 439/607.17
2006/0052008 A1 * 3/2006 Pan ..... H01R 12/716 439/660
2017/0033505 A1 * 2/2017 Ozeki ..... H01R 13/6594

* cited by examiner

CONNECTOR

CROSS REFERENCE TO RELATED APPLICATIONS

This application is based on and claims priority under 35 U.S.C. § 119 to Japanese Patent Application No. JP2018-167872 filed Sep. 7, 2018, the content of which is incorporated herein in its entirety by reference.

BACKGROUND OF THE INVENTION

This invention relates to a floating connector.

For example, a floating connector is disclosed in JP2018-37151A (Patent Document 1), the content of which is incorporated herein by reference.

Referring to FIG. 40, Patent Document 1 discloses a receptacle connector (connector) 90 which comprises a fixed housing 92, a movable housing 94 and a plurality of terminals (contacts) 96. Each of the contacts 96 has a middle resilient portion 962 and a contact arm 966 each of which is resiliently deformable. The middle resilient portion 962 has a held portion 964, and the contact arm 966 has a fixed portion 968. The held portion 964 is integrally molded with the fixed housing 92 and is fixed to the fixed housing 92. The fixed portion 968 is integrally molded with the movable housing 94 and is fixed to the movable housing 94. Thus, each of the contacts 96 has two spring portions, namely the middle resilient portion 962 and the contact arm 966, which are resiliently deformable independently of each other.

According to the aforementioned structure, the middle resilient portions 962 support the movable housing 94 so that the movable housing 94 is movable relative to the fixed housing 92. In other words, the connector 90 is a floating connector. When the connector 90 is mated with a mating connector (not shown), the contact arms 966 are moved and resiliently deformed so as to follow the relative movement of the movable housing 94, so that the contact arms 966 are brought into contact with mating contacts (not shown), respectively, with sufficient contact pressure.

As disclosed in Patent Document 1, a contact of an existing floating connector is required to be provided with two spring portions, or a spring portion for floating and another spring portion for contact, which are resiliently deformable independently of each other. This requirement generally makes the size of the connector large.

SUMMARY OF THE INVENTION

It is therefore an object of the present invention to provide a new structure which enables reduction of the size of a floating connector.

An aspect of the present invention provides a connector mateable with a mating connector along an upper-lower direction. The connector comprises a fixed housing, a movable housing and a plurality of contacts. The fixed housing has a housing-accommodation portion and a plurality of holding portions which correspond to the contacts, respectively. The housing-accommodation portion opens upward. The holding portions are arranged in a pitch direction perpendicular to the upper-lower direction. The movable housing is, at least in part, accommodated in the housing-accommodation portion. The movable housing is movable relative to the fixed housing along the upper-lower direction and is movable relative to the fixed housing along a horizontal plane perpendicular to the upper-lower direction. The movable housing has a receiving portion, one or more partitions, a catching portion and a plurality of contact-accommodation portions which correspond to the contacts, respectively. The receiving portion opens upward and receives, at least in part, the mating connector under a mated state where the connector and the mating connector are mated with each other. The contact-accommodation portions are arranged in the pitch direction and communicate with the receiving portion in a width direction perpendicular to both the upper-lower direction and the pitch direction. Each of the partitions is located between adjacent two of the contact-accommodation portions in the pitch direction. Each of the contacts has a held portion and a resiliently deformable portion. Each of the held portions is held by a corresponding one of the holding portions. Each of the resiliently deformable portions is resiliently deformable and is, at least in part, accommodated in a corresponding one of the contact-accommodation portions under a separated state where the connector and the mating connector are separated from each other. Each of the resiliently deformable portions is provided with a contact portion and a facing portion. Each of the facing portions is located between the held portion and the contact portion in the width direction. Each of the facing portions is in contact with the catching portion or faces the catching portion at a distance apart therefrom in the width direction. A movement of the movable housing relative to the fixed housing enables the facing portions to be pressed against the catching portion while allowing movements of the facing portions at least in the upper-lower direction.

The connector according to an aspect of the present invention comprises the fixed housing and the movable housing which is movable relative to the fixed housing. Thus, the connector according to an aspect of the present invention is a floating connector.

According to an aspect of the present invention, the movable housing has the catching portion, and each of the contacts has the resiliently deformable portion which is provided with the contact portion and the facing portion. When the facing portion is pressed against the catching portion in accordance with a relative movement of the movable housing, the facing portion is kept to be movable at least in the upper-lower direction. According to this structure, even in a case where the movable housing is moved relative to the fixed housing, the resiliently deformable portion keeps its spring characteristics, so that the contact portion can be in contact with a mating contact with sufficient contact pressure. The thus-formed single resiliently deformable portion can be used both as a spring portion for floating and another spring portion for contact without fixing the contact to the movable housing, so that the size of the connector can be reduced. Thus, an aspect of the present invention provides a new structure which enables reduction of the size of the floating connector.

An appreciation of the objectives of the present invention and a more complete understanding of its structure may be had by studying the following description of the preferred embodiment and by referring to the accompanying drawings.

Figure 1:
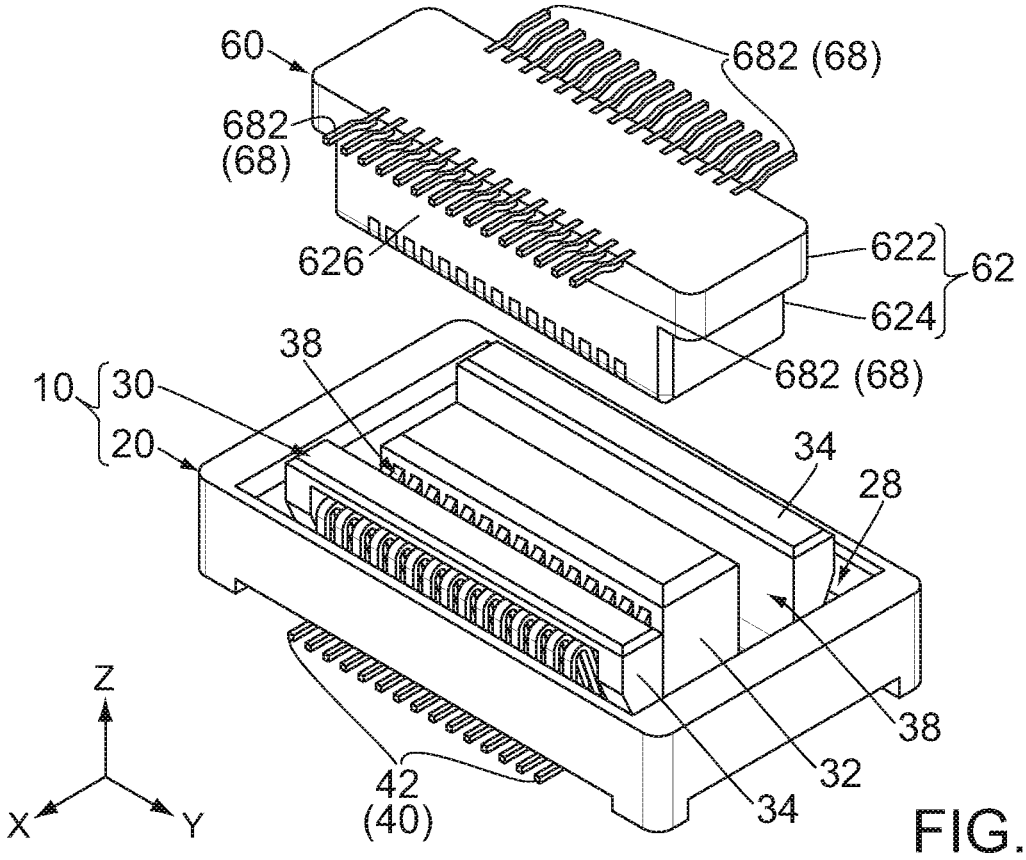
FIG. 1 is a perspective view showing a connector and a mating connector according to a first embodiment of the present invention, wherein the connector and the mating connector are separated from each other.
Figure 2:
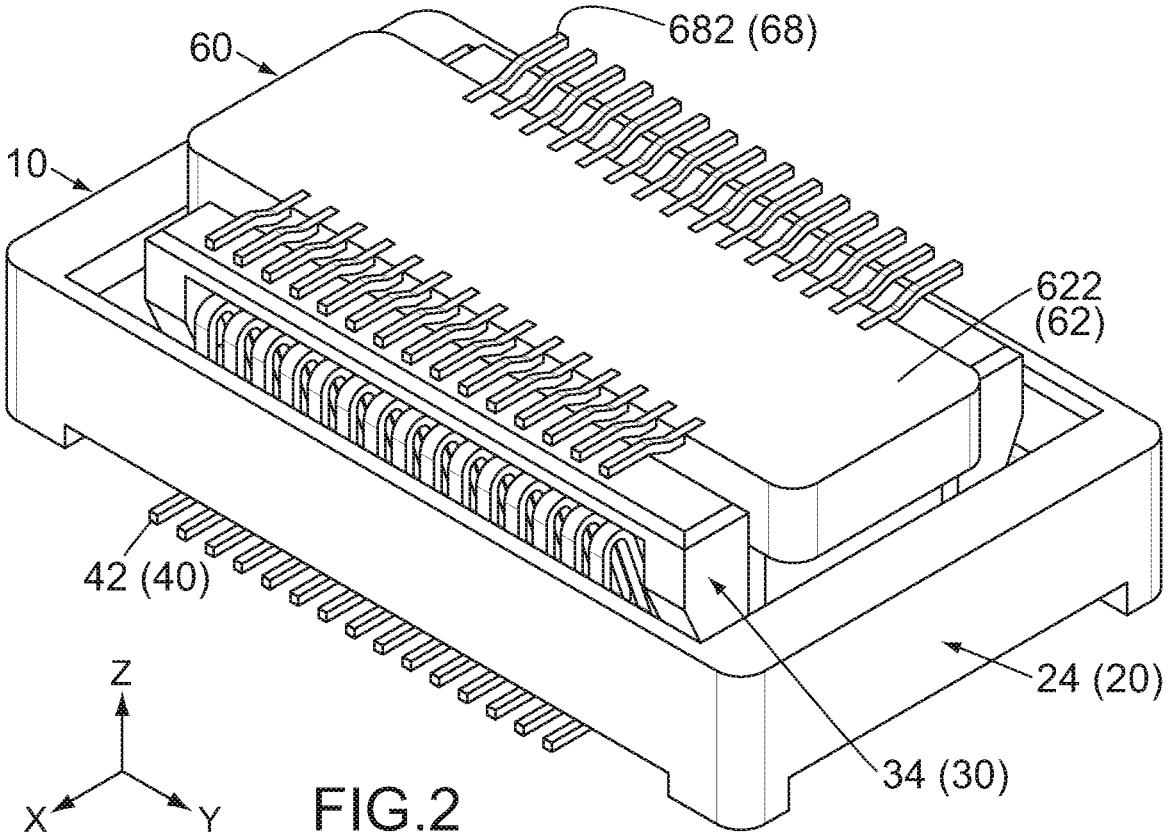
FIG. 2 is a perspective view showing the connector and the mating connector of FIG. 1, wherein the connector and the mating connector are mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIGS. 1 to 4, a connector 10 according to a first embodiment of the present invention is mateable with a mating connector 60 along an upper-lower direction (Z-direction: mating direction). The mating connector 60 mated with the connector 10 is removable from the connector 10 along the Z-direction. In the present embodiment, the connector 10 is an on-board connector which is to be mounted on a circuit board 82, and the mating connector 60 is another on-board connector which is to be mounted on a mating circuit board 86. Moreover, the connector 10 is a receptacle, and the mating connector 60 is a plug. However, the present invention is not limited thereto but is applicable to various connectors.

Figure 9:
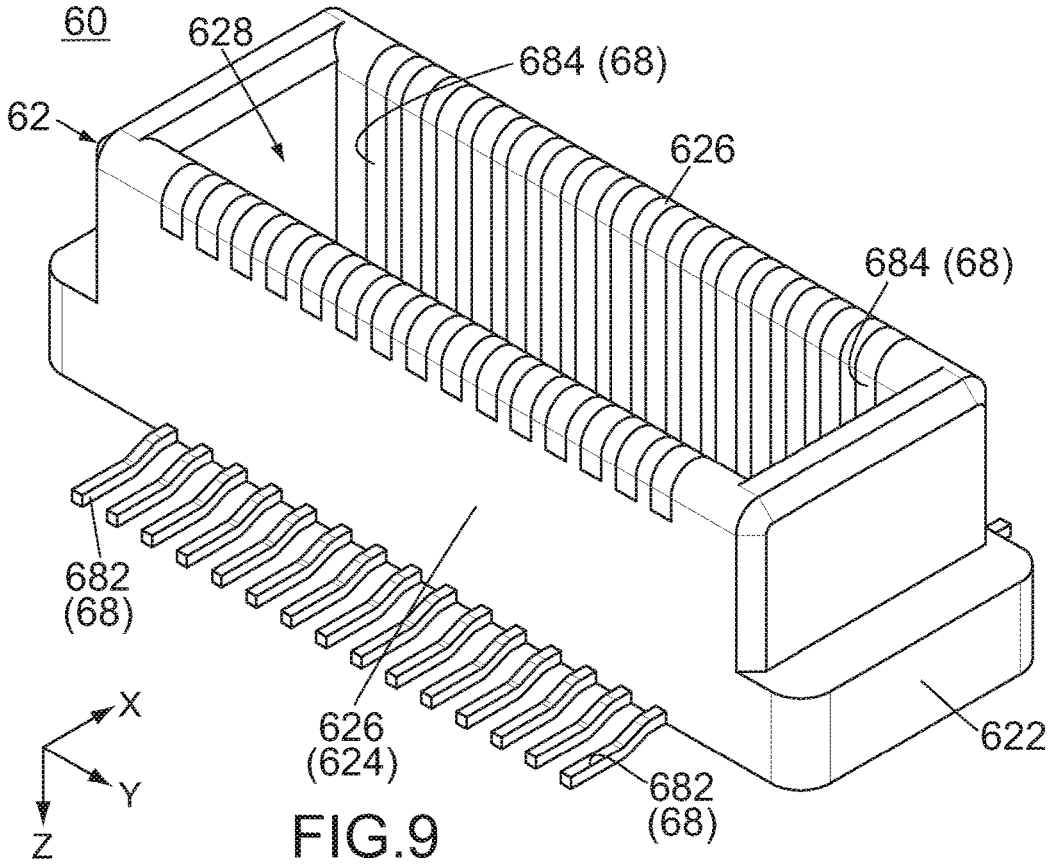
FIG. 9 is a perspective view showing the mating connector of FIG. 1.
Figure 10:
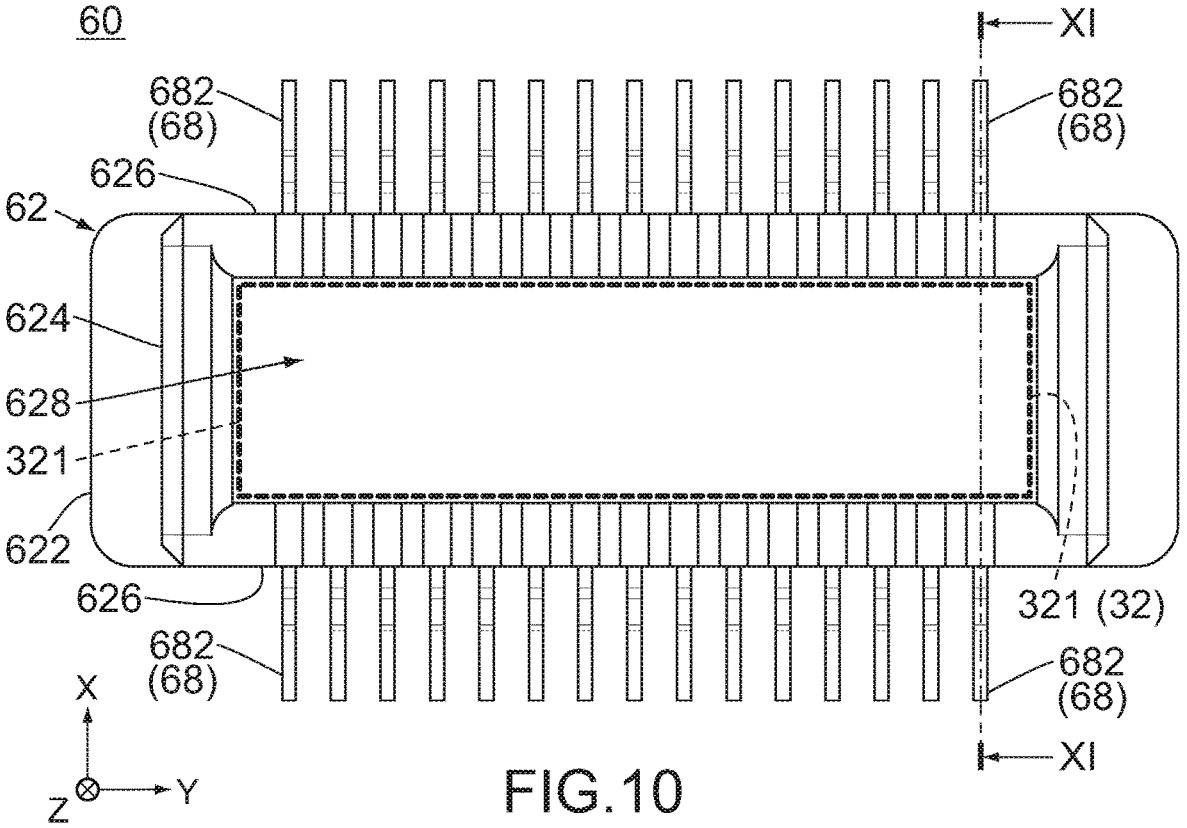
FIG. 10 is a plan view showing the mating connector of FIG. 9, wherein an outline of a body portion of the movable housing of the connector mated with the mating connector is illustrated with dashed line.
Figure 11:
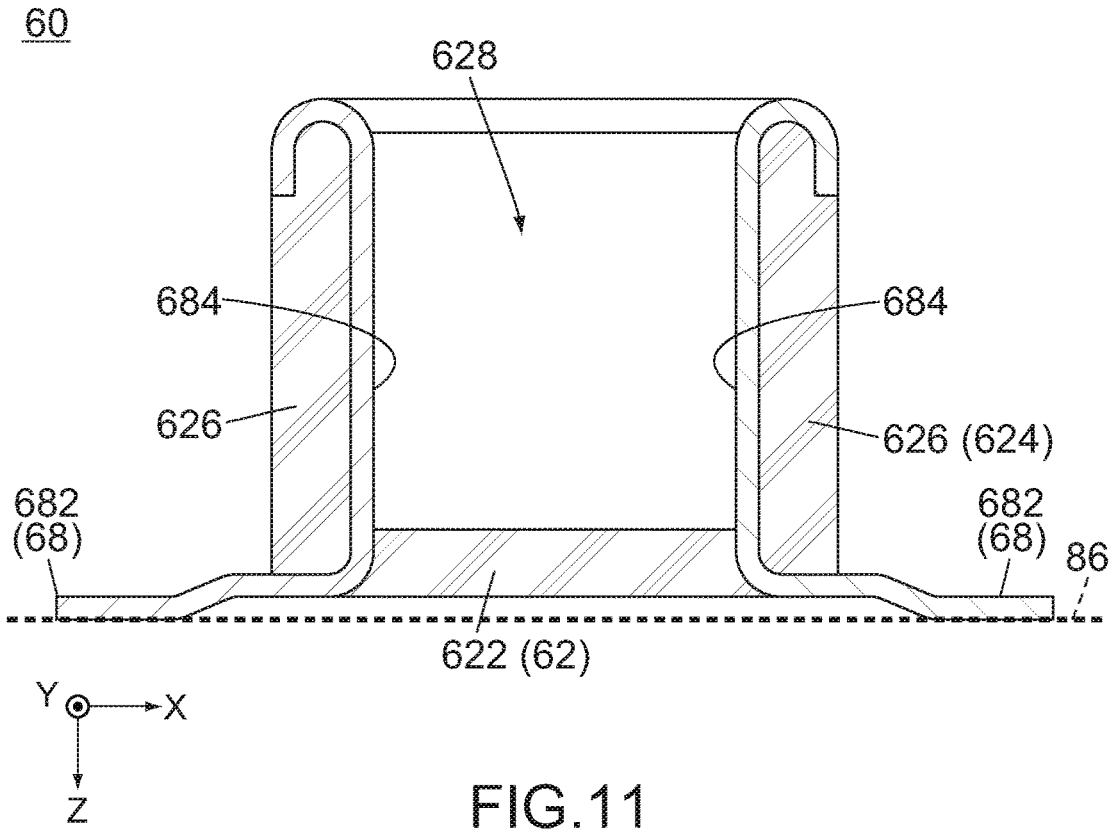
FIG. 11 is a cross-sectional view showing the mating connector of FIG. 10, taken along line XI-XI, wherein a part of the mating circuit board is illustrated with dashed line.

Referring to FIGS. 1 and 9 to 11, the mating connector 60 comprises a mating housing 62 made of insulator and a plurality of mating contacts 68 each made of conductor. The mating housing 62 has a base portion 622 and a mating peripheral wall 624. Referring to FIG. 11, the base portion 622 is mounted on and fixed to the mating circuit board 86 when the mating connector 60 is used. Referring to FIGS. 9 and 10, the mating peripheral wall 624 extends along the outer periphery of the base portion 622 in a horizontal plane (XY-plane) perpendicular to the Z-direction and extends away from the base portion 622 in the Z-direction. The mating peripheral wall 624 has two mating sidewalls 626. Each of the mating sidewalls 626 extends along the YZ-plane.

Figure 5:
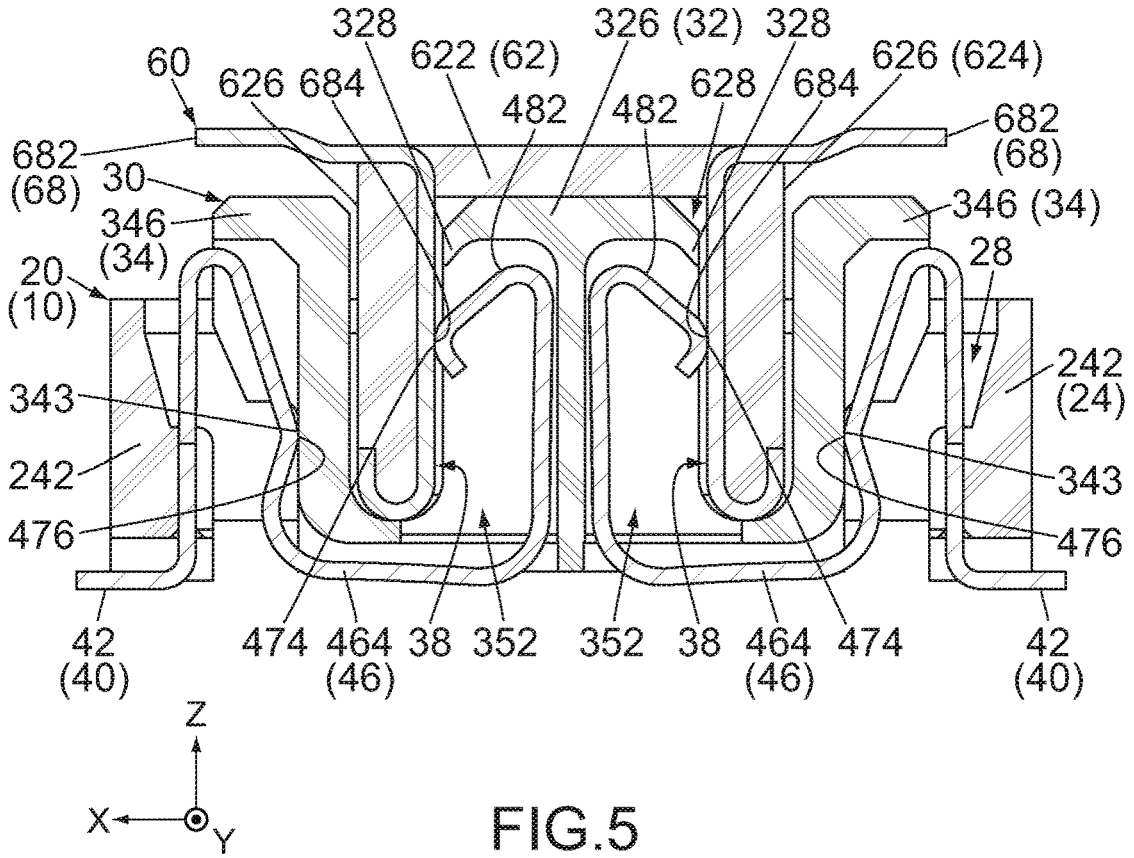
FIG. 5 is a cross-sectional view showing the connector and the mating connector of FIG. 4, taken along line V-V.

As shown in FIGS. 9 to 11, the mating housing 62 is formed with a mating receiving portion 628. The mating receiving portion 628 is a space enclosed by the mating peripheral wall 624 in the XY-plane. The two mating sidewalls 626 are located across the mating receiving portion 628 from each other in a width direction (X-direction) perpendicular to the Z-direction. Under a separated state (see FIG. 1) where the connector 10 (see FIG. 1) and the mating connector 60 are separated from each other, the mating receiving portion 628 opens at an opposite end of the mating housing 62 which is opposite to the base portion 622 in the Z-direction. Referring to FIG. 5, the mating receiving portion 628 receives, at least in part, the connector 10 under a mated state where the connector 10 and the mating connector 60 are mated with each other.

Referring to FIGS. 1, 9 and 10, the mating contacts 68 have shapes same as one another and are grouped into two rows in the X-direction. The two rows of the mating contacts 68 correspond to the two mating sidewalls 626, respectively. The two rows of the mating contacts 68 are arranged to be mirror images of each other with respect to the YZ-plane. In other words, the arrangement of the two rows of the mating contacts 68 is mirror-symmetrical with respect to the YZ-plane. The mating contacts 68 of each row are held by the corresponding mating sidewall 626 and are arranged at regular intervals in a pitch direction (Y-direction) perpendicular to both the X-direction and the Z-direction.

Referring to FIGS. 9 and 11, each of the mating contacts 68 is a single metal plate with bends and has a mating fixed portion 682 and a mating contact portion 684. Each of the mating fixed portions 682 is partially embedded in the base portion 622 and projects outward in the X-direction from the base portion 622. When the mating connector 60 is used, each of the mating fixed portions 682 is fixed on and connected to a conductive pad (not shown) of the mating circuit board 86 via soldering, etc. Each of the mating contact portions 684 is embedded in an inner part of the corresponding mating sidewall 626 and extends along the Z-direction while being partially exposed in the mating receiving portion 628.

The mating connector 60 of the present embodiment has the aforementioned structure. However, the structure of the mating connector 60 can be modified in accordance with the structure of the connector 10.

Referring to FIGS. 1 and 12 to 15, the connector 10 comprises a fixed housing 20 made of insulator, a movable housing 30 made of insulator and a plurality of contacts 40 each of which is made of conductor and which correspond to the mating contacts 68, respectively. The connector 10 of the present embodiment consists of the aforementioned members. However, the connector 10 may further comprise another member. Hereafter, explanation will be made about the structure of each member of the connector 10.

Figure 13:
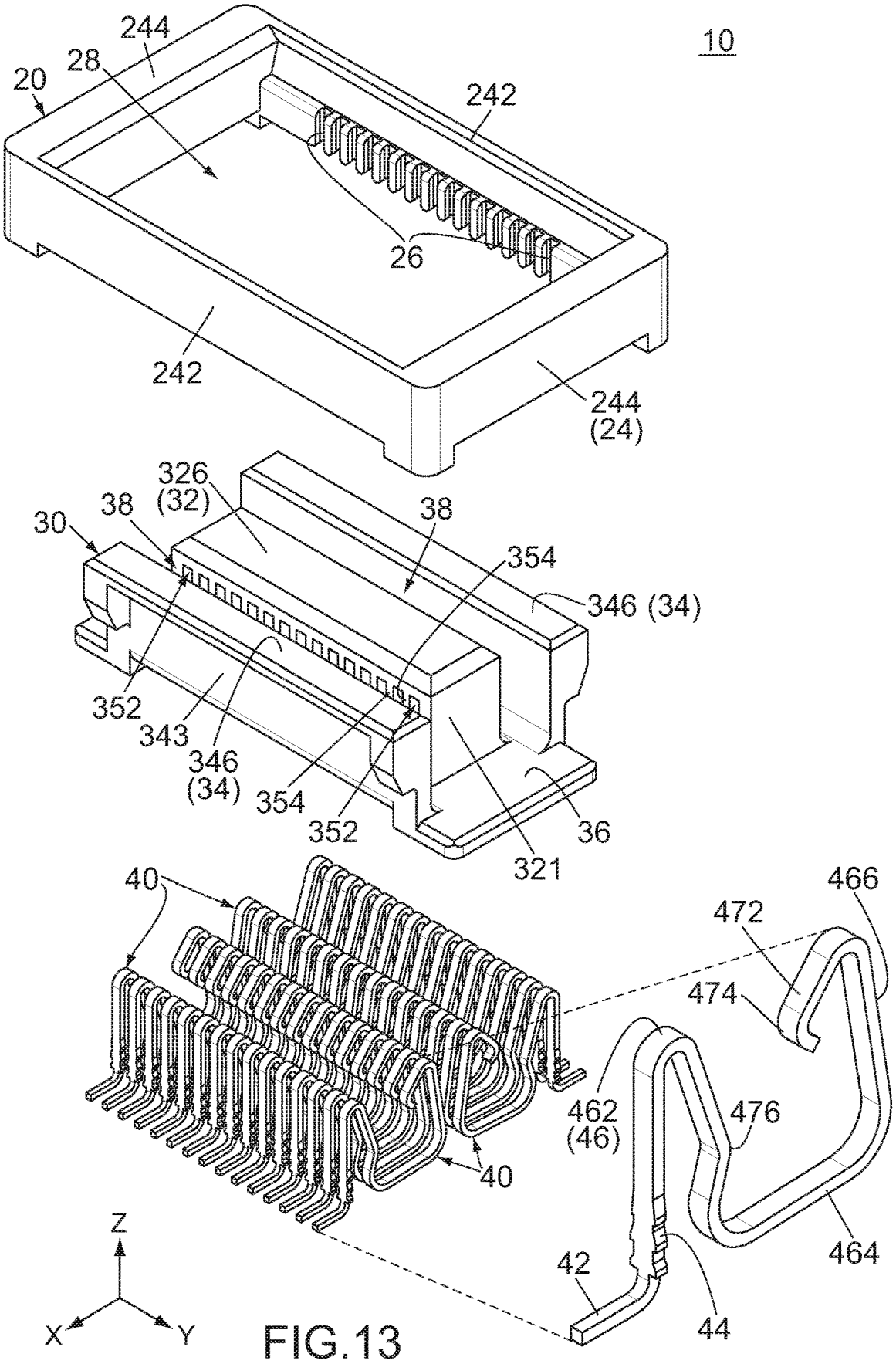
FIG. 13 is an exploded perspective view showing the connector of FIG. 1, wherein one of contacts is enlarged to be illustrated.
Figure 14:
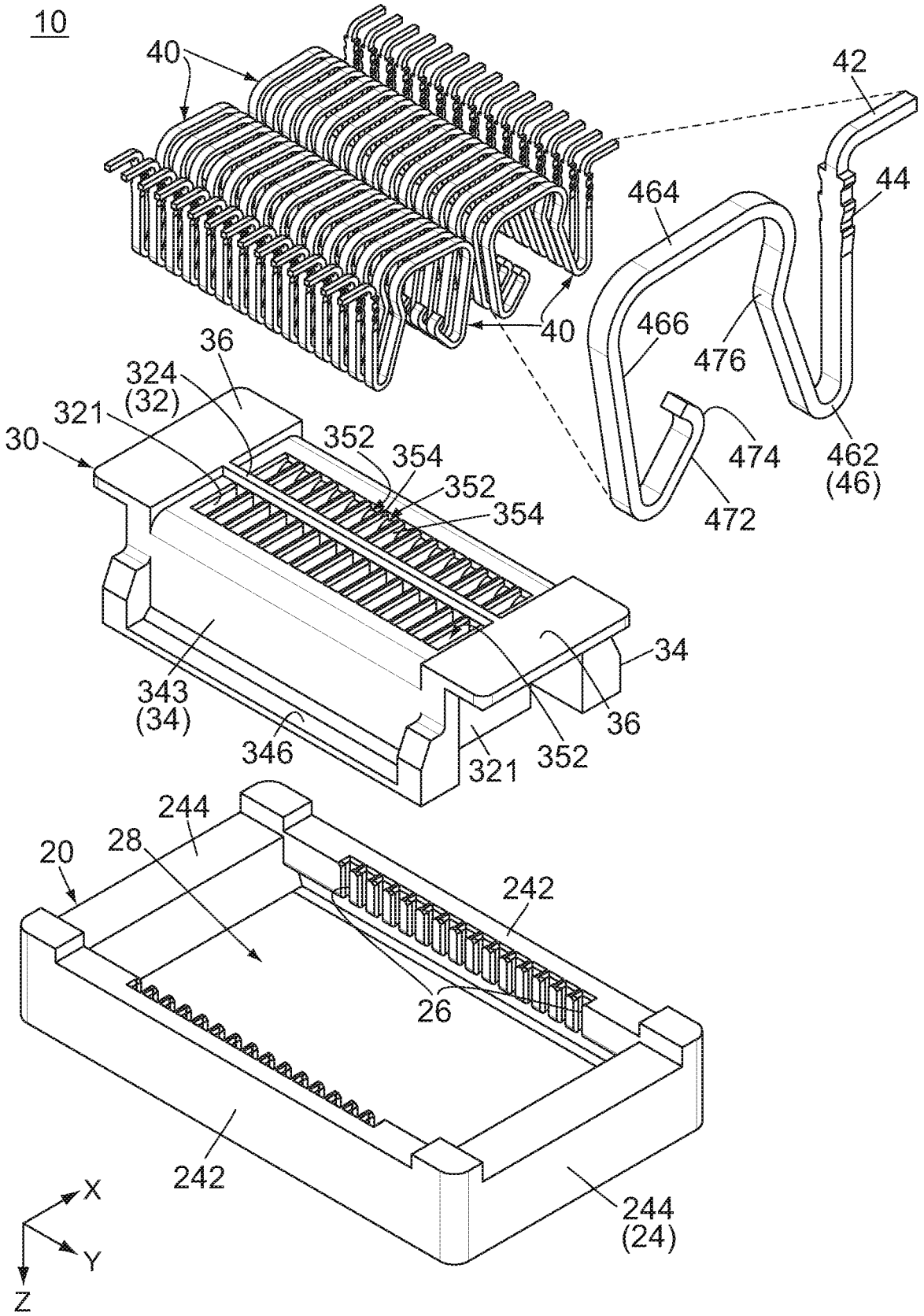
FIG. 14 is an exploded perspective view showing the connector of FIG. 12, wherein one of the contacts is enlarged to be illustrated.
Figure 15:
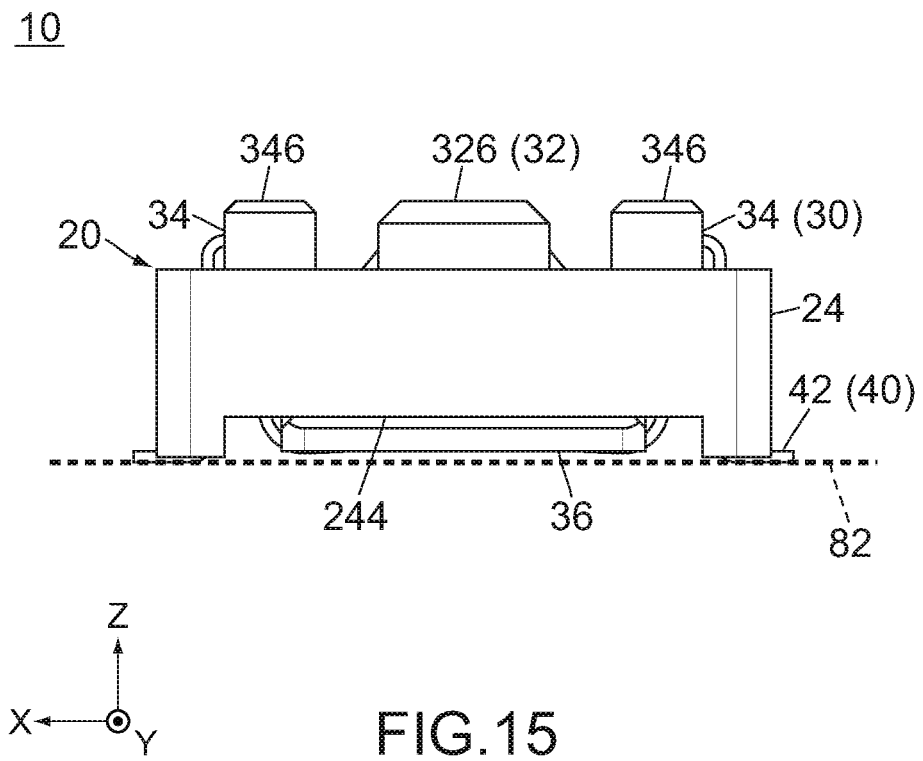
FIG. 15 is a side view showing the connector of FIG. 1, wherein a part of the circuit board is illustrated with dashed line.

Referring to FIG. 15, the fixed housing 20 is mounted on and fixed to the circuit board 82 when the connector 10 is used. Referring to FIGS. 13 and 14, the fixed housing 20 has a peripheral wall 24 and a housing-accommodation portion 28. The peripheral wall 24 of the present embodiment has a rectangular frame shape in the XY-plane. The housing-accommodation portion 28 is a space enclosed by the peripheral wall 24 in the XY-plane. The housing-accommodation portion 28 opens upward and downward, or opens in the positive Z-direction and in the negative Z-direction. However, the housing-accommodation portion 28 may open only upward.

The peripheral wall 24 has two sidewalls 242 and two coupling walls (movement restriction portions) 244. Each of the sidewalls 242 extends along the Y-direction. The two sidewalls 242 are located across the housing-accommodation portion 28 from each other in the X-direction. Each of the coupling walls 244 extends along the X-direction and couples the two sidewalls 242 to each other in the X-direction.

The fixed housing 20 has a plurality of holding portions 26 which correspond to the contacts 40, respectively. The holding portions 26 of the present embodiment are grouped into two rows in the X-direction. The holding portions 26 of each row have shapes same as one another and are arranged at regular intervals in the Y-direction. The two rows of the holding portions 26 are provided so as to correspond to the two sidewalls 242, respectively, and are arranged to be mirror images of each other with respect to the YZ-plane. In other words, the arrangement of the two rows of the holding portions 26 is mirror-symmetrical with respect to the YZ-plane. Each of the holding portions 26 is a groove formed on an inner part of the sidewall 242. However, the present invention is not limited thereto. For example, each of the holding portions 26 may have any structure, provided that the corresponding contact 40 can be held thereby. Moreover, the holding portions 26 may be formed on only one of the two sidewalls 242. In other words, the fixed housing 20 may have only one row of the holding portions 26 arranged in the Y-direction.

Referring to FIGS. 1, 13 and 14, the movable housing 30 of the present embodiment has a body portion 32, two outer walls 34 and two flanges (restricted portions) 36. Each of the body portion 32 and the outer walls 34 projects upward from a lower end, or the negative Z-side end, of the movable housing 30 and extends along the Y-direction. The body portion 32 is located between the two outer walls 34 in the X-direction. The body portion 32 has opposite lower ends in the X-direction which are connected to lower ends of the two outer walls 34, respectively. Each of the outer walls 34 has an outer surface (catching portion) 343. Thus, the movable housing 30 has the two outer surfaces (catching portions) 343. Each of the outer surfaces 343 is an outer surface of the outer wall 34 in the X-direction and extends along the YZ-plane. The flanges 36 are located at opposite sides of the movable housing 30 in the Y-direction, respectively. Each of the flanges 36 projects outward in the Y-direction from the lower end of the movable housing 30 and has a flat plate shape extending along the XY-plane.

The body portion 32, the outer walls 34 and the flanges 36 of the movable housing 30 of the present embodiment have the structures as described above. However, the structure of the movable housing 30 can be variously modified as described later in the present embodiment and other embodiments.

Figure 16:
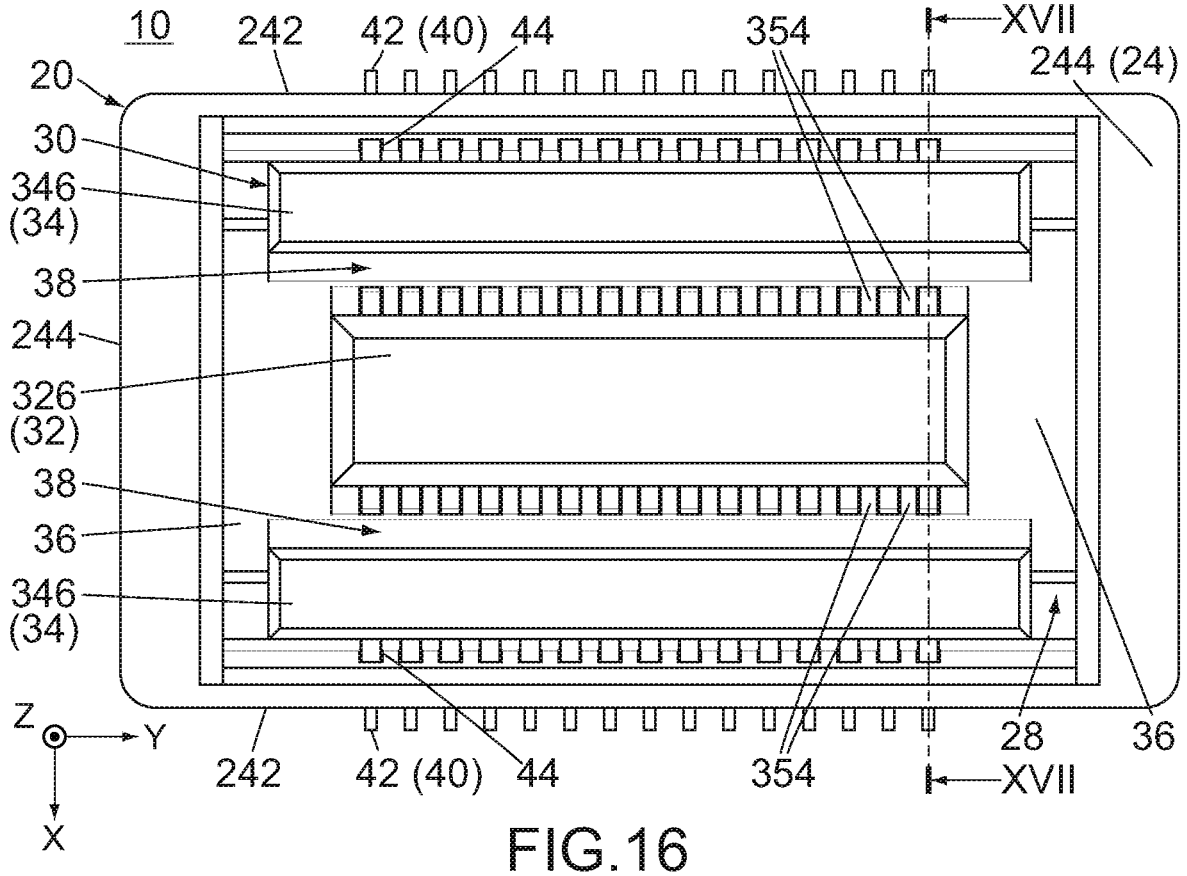
FIG. 16 is a plan view showing the connector of FIG. 1.

Referring to FIGS. 1, 13 and 16, the movable housing 30 of the present embodiment has two receiving portions 38. Each of the receiving portions 38 is a space which opens upward. Referring to FIG. 5, the two receiving portions 38 of the present embodiment partially receive the two mating sidewalls 626 of the mating connector 60, respectively, under the mated state. However, the present invention is not limited thereto. For example, the number of the receiving portion 38 may be one. Under the mated state, the receiving portion 38 may receive a part of the mating connector 60 provided with the mating contacts 68. Thus, each of the receiving portions 38 may receive, at least in part, the mating connector 60 under the mated state.

Referring to FIG. 13, in the present embodiment, the two receiving portions 38 correspond to the two outer walls 34, respectively. Each of the receiving portions 38 is located between the corresponding outer wall 34 and the body portion 32 in the X-direction. However, the structure of the receiving portion 38 can be variously modified, provided that the movable housing 30 is provided with one or more of the receiving portions 38. For example, in a case where the movable housing 30 is not provided with the outer walls 34, two spaces which are located at opposite sides of the body portion 32 in the X-direction may work as the receiving portions 38, respectively. In another case where the movable housing 30 is not provided with the body portion 32, a single space which is located between the two outer walls 34 in the X-direction may work as the receiving portion 38.

Figure 12:
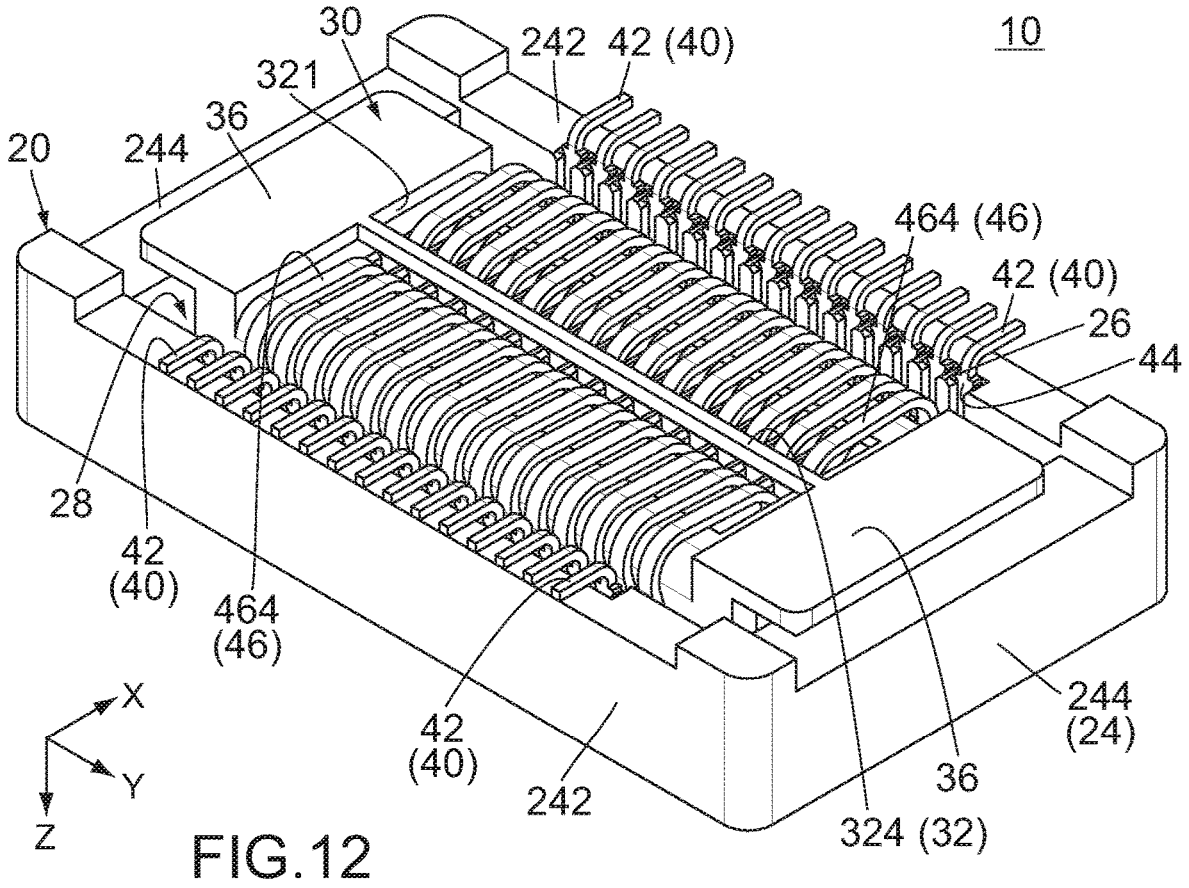
FIG. 12 is a perspective view showing the connector of FIG. 1.
Figure 18:
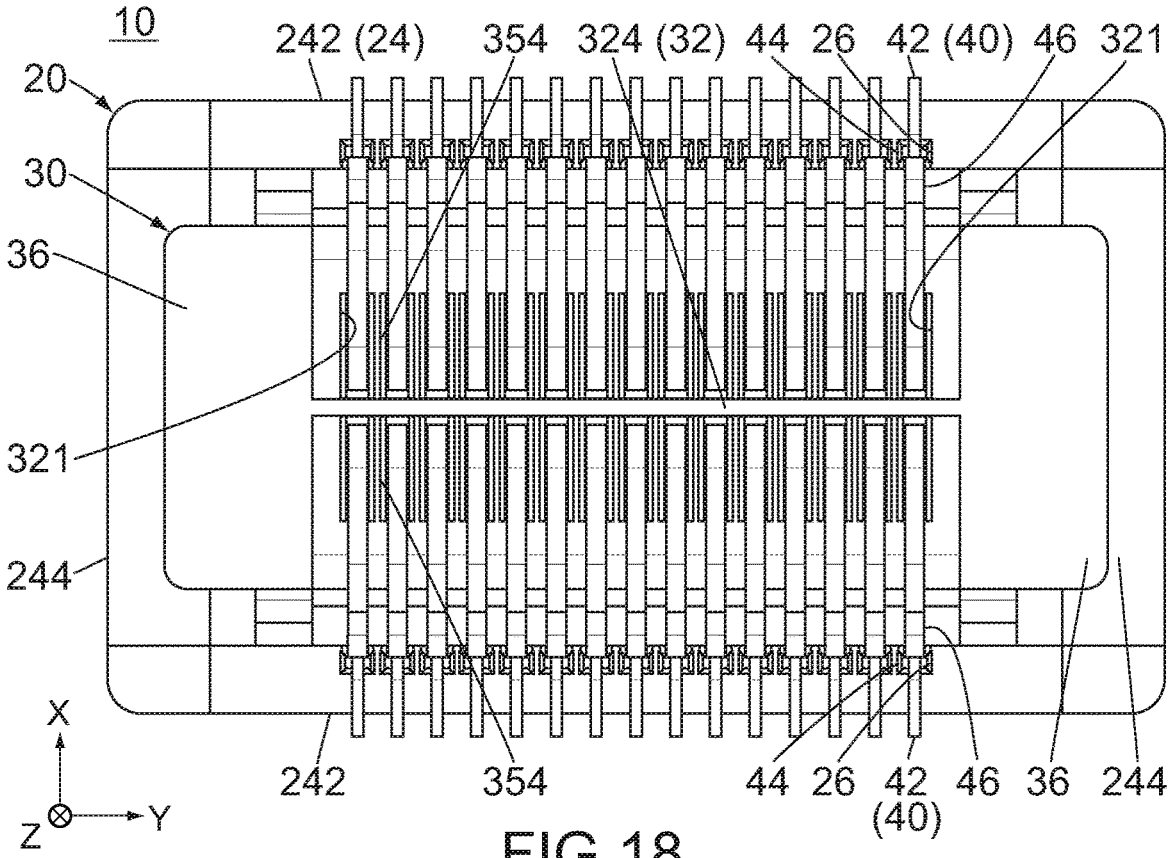
FIG. 18 is a plan view showing the connector of FIG. 12.

Referring to FIGS. 12, 14 and 18, the body portion 32 of the present embodiment has two end plates 321 and a separation portion 324. Referring to FIG. 14, the end plates 321 are located at opposite ends of the body portion 32 in the Y-direction, respectively. Each of the end plates 321 extends along the XZ-plane. The separation portion 324 extends along the Y-direction in an area between the two end plates 321. The separation portion 324 is located at the middle of the body portion 32 in the X-direction and extends along the YZ-plane. The movable housing 30 of the present embodiment has the end plates 321 and the separation portion 324 which are formed as described above.

Referring to FIGS. 13 and 15, in the present embodiment, the body portion 32 has a top plate 326, and each of the outer walls 34 has an additional top plate 346. The top plate 326 is located at an upper end, or the positive Z-side end, of the body portion 32 and extends along the XY-plane as a whole. Each of the additional top plates 346 is located at an upper end of the outer wall 34 and extends along the XY-plane as a whole. Thus, the movable housing 30 of the present embodiment has the top plate 326 located at the upper end of the body portion 32 and the two additional top plates 346 located at the upper ends of the outer walls 34, respectively. In the present embodiment, each of the top plate 326 and the additional top plates 346 is a part of the movable housing 30. However, each of the top plate 326 and the additional top plates 346 may be a member separable from the movable housing 30.

Referring to FIGS. 13 and 14, the movable housing 30 has a plurality of contact-accommodation portions 352 which correspond to the contacts 40, respectively. Each of the contact-accommodation portions 352 is a space which opens downward. The contact-accommodation portions 352 are grouped into two rows in the X-direction. The contact-accommodation portions 352 of each row have shapes same as one another and are arranged at regular intervals in the Y-direction. The two rows of the contact-accommodation portions 352 are arranged to be mirror images of each other with respect to the YZ-plane. In other words, the arrangement of the two rows of the contact-accommodation portions 352 is mirror-symmetrical with respect to the YZ-plane. The two rows of the contact-accommodation portions 352 are provided so as to correspond to the two receiving portions 38, respectively. Thus, the two rows of the contact-accommodation portions 352 correspond to the two outer walls 34, respectively.

Figure 17:
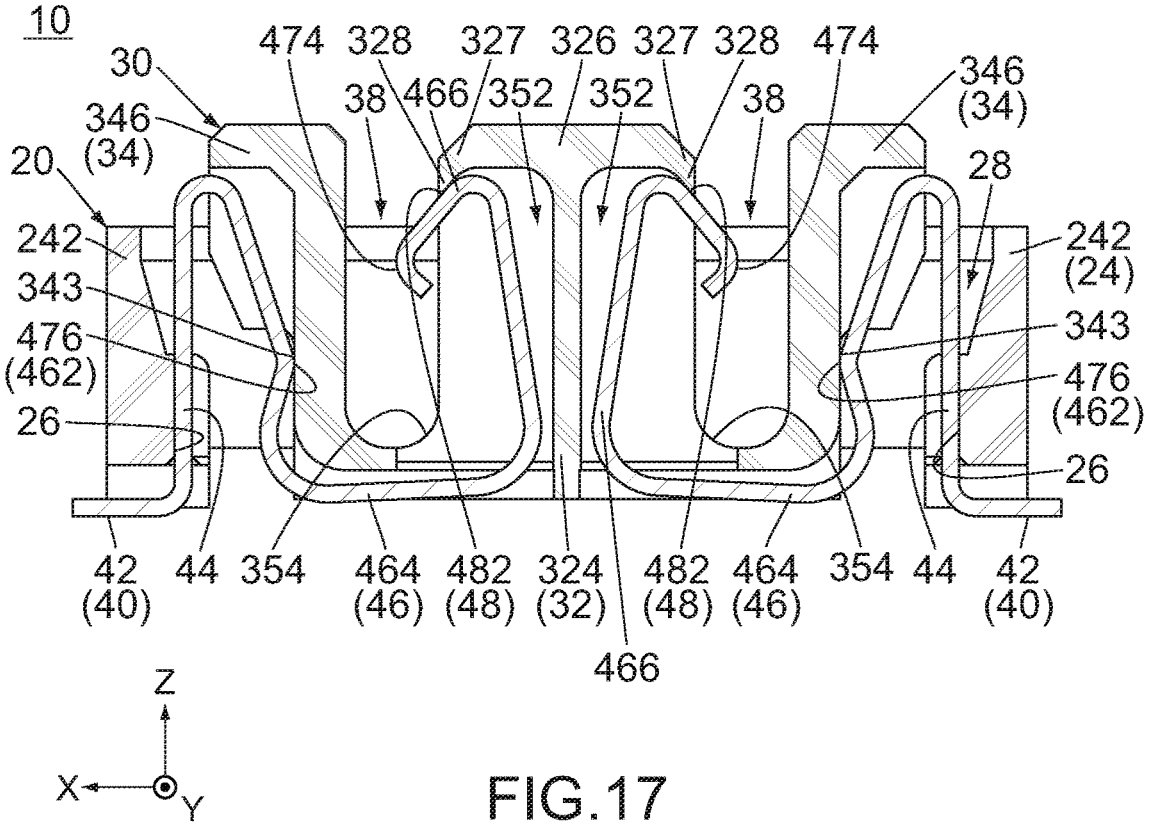
FIG. 17 is a cross-sectional view showing the connector of FIG. 16, taken along line XVII-XVII.

Referring to FIGS. 14 and 17, each of the outer walls 34 has an inner end in the X-direction. Each of the contact-accommodation portions 352 extends between the inner end of the corresponding outer wall 34 and the separation portion 324 of the body portion 32 in the X-direction while having a constant size in the Y-direction. Each of the contact-accommodation portions 352 communicates with the corresponding receiving portion 38 in the X-direction. In detail, each of the contact-accommodation portions 352 is mainly located under the top plate 326 of the body portion 32 and is partially located under the corresponding receiving portion 38. Moreover, each of the contact-accommodation portions 352 is located adjacent to and inward of the corresponding receiving portion 38 in the X-direction.

Referring to FIGS. 14 and 16, the movable housing 30 has a plurality of partitions 354. Referring to FIG. 14, each of the partitions 354 is located between adjacent two of the contact-accommodation portions 352 in the Y-direction and extends between the inner end of the corresponding outer wall 34 and the separation portion 324 of the body portion 32 in the X-direction.

The contact-accommodation portions 352 and the partitions 354 of the present embodiment are formed and arranged as described above. However, the present invention is not limited thereto. For example, the size of each of the contact-accommodation portions 352 in the Y-direction is not limited to be constant. The contact-accommodation portions 352 and the partitions 354 may be provided so as to correspond only one of the outer walls 34. In other words, the movable housing 30 may have only one row of the contact-accommodation portions 352 and the partitions 354 arranged in the Y-direction. According to this structure, the number of the contact-accommodation portions 352 may be two, and the number of the partition 354 may be one. Thus, the movable housing 30 may have two or more of the contact-accommodation portions 352 and one or more of the partitions 354.

Referring to FIGS. 13 and 14, the contacts 40 of the present embodiment have shapes same as one another and are grouped into two rows in the X-direction so as to correspond to the contact-accommodation portions 352, respectively. The two rows of the contacts 40 are arranged to be mirror images of each other with respect to the YZ-plane. In other words, the arrangement of the two rows of the contacts 40 is mirror-symmetrical with respect to the YZ-plane. The contacts 40 of each row are arranged at regular intervals in the Y-direction. However, the present invention is not limited thereto. For example, the contacts 40 may have shapes different from one another. Moreover, the connector 10 may have only one row of the contacts 40 arranged in the Y-direction.

Each of the contacts 40 of the present embodiment is a single metal plate with bends and has a fixed portion 42, a held portion 44 and a resiliently deformable portion 46. The fixed portion 42 extends along the X-direction. The held portion 44 extends upward from an inner end of the fixed portion 42 in the X-direction. The resiliently deformable portion 46 extends and meanders in the XZ-plane so that the resiliently deformable portion 46 is resiliently deformable. In detail, each of the resiliently deformable portions 46 has an outer portion 462, a bottom portion 464 and an inner portion 466. The outer portion 462 first extends upward from an upper end of the held portion 44. Then, the outer portion 462 arcuately extends upward and inward in the X-direction and subsequently extends downward while partially protruding inward in the X-direction. The bottom portion 464 extends inward in the X-direction from a lower end of the outer portion 462. The inner portion 466 first extends upward from an inner end of the bottom portion 464 in the X-direction. Then, the inner portion 466 extends downward while partially protruding outward in the X-direction.

Each of the inner portions 466 has a guide portion 472 and a contact portion 474. Each of the outer portions 462 has a facing portion 476. The guide portion 472 extends downward and outward in the X-direction. The facing portion 476 is located between the held portion 44 and the contact portion 474 in the X-direction. The contact portion 474 and the facing portion 476 are located at positions different from each other in the Z-direction and face in opposite directions in the X-direction. In the present embodiment, the contact portion 474 faces outward in the X-direction, and the facing portion 476 faces inward in the X-direction. In other words, the contact portion 474 and the facing portion 476 protrude toward each other in the X-direction. Each of the resiliently deformable portions 46 of the present embodiment is provided with the contact portion 474 and the facing portion 476 which are formed as described above. However, the structure of the contact according to the present invention can be variously modified as described later in the present embodiment and the other embodiments.

Referring to FIGS. 12 to 14, in the present embodiment, the aforementioned members are combined as described below, so that the connector 10 is formed. First, the movable housing 30 is inserted into the housing-accommodation portion 28 of the fixed housing 20 from below. Then, each of the contacts 40 is attached to the fixed housing 20 from below. Each of the thus-attached contacts 40 is partially accommodated in the movable housing 30.

Referring to FIGS. 12 and 17, the held portion 44 of each of the contacts 40 is press-fit into the corresponding holding portion 26 of the fixed housing 20 from below and is held by the corresponding holding portion 26. Referring to FIGS. 14 and 17, the inner portion 466 of the resiliently deformable portion 46 of each of the contacts 40 is inserted into the corresponding contact-accommodation portion 352 and is partially accommodated in the corresponding contact-accommodation portion 352. The outer portion 462 of the resiliently deformable portion 46 of each of the contacts 40 is arranged outward of the outer surface 343 of the corresponding outer wall 34. Referring to FIG. 17, the fixed portion 42 of each of the contacts 40 is hereby exposed downward from the fixed housing 20. Referring to FIG. 15, when the connector 10 is used, each of the fixed portions 42 is fixed on and connected to a conductive pad (not shown) of the circuit board 82 via soldering, etc.

As described above, the connector 10 of the present embodiment can be easily formed only by combining the movable housing 30 and the contacts 40 to the fixed housing 20 from below. However, the present invention is not limited thereto. For example, the movable housing 30 and the contacts 40 may be formed so as to be combinable to the fixed housing 20 from above.

Hereafter, explanation will be made about the structure of the connector 10 which is assembled as described above.

Referring to FIGS. 12 and 15 to 17, in the XY-plane, a part of the movable housing 30 is located in the housing-accommodation portion 28 of the fixed housing 20 while being apart from the peripheral wall 24. In addition, referring to FIGS. 12 and 15, the two restricted portions 36 are located under and apart from the two movement restriction portions 244 of the fixed housing 20, respectively. The thus-arranged movable housing 30 is movable relative to the fixed housing 20 along the Z-direction and is movable relative to the fixed housing 20 along the XY-plane. Thus, the connector 10 is a floating connector.

According to the present embodiment, the movement restriction portions 244 are located above the restricted portions 36, respectively, and restrict an upward movement of the movable housing 30 relative to the fixed housing 20 within a predetermined range. This restriction of the upward movement prevents the movable housing 30 from coming out upward from the fixed housing 20. In addition, referring to FIG. 15, the circuit board 82 restricts a downward movement of the movable housing 30 relative to the fixed housing 20 when the connector 10 is used.

Referring to FIG. 12, in the present embodiment, the movement restriction portions 244 are the coupling walls 244 of the fixed housing 20, and the restricted portions 36 are the flanges 36 of the movable housing 30. Thus, the fixed housing 20 has the two movement restriction portions 244, and the movable housing 30 has the two restricted portions 36 which correspond to the movement restriction portions 244, respectively. Each of the movement restriction portions 244 is a part of the fixed housing 20, and each of the restricted portions 36 is a part of the movable housing 30. However, the present invention is not limited thereto. For example, a part of the fixed housing 20 other than the coupling walls 244 may work as a movement restriction portion, and a part of the movable housing 30 other than the flanges 36 may work as a restricted portion. Each of the movement restriction portions 244 may be a member separable from the fixed housing 20, and each of the restricted portions 36 may be a member separable from the movable housing 30. Each of the number of the movement restriction portions 244 and the number of the restricted portions 36 is not limited to two. Moreover, the movement restriction portions 244 and the restricted portions 36 may be provided as necessary.

According to the present embodiment, the peripheral wall 24 of the fixed housing 20 encloses the movable housing 30 in the XY-plane and restricts another movement of the movable housing 30 relative to the fixed housing 20 along the XY-plane within another predetermined range. However, the present invention is not limited thereto. For example, a part of the fixed housing 20 other than the peripheral wall 24 may restrict the relative movement of the movable housing 30 along the XY-plane.

Referring to FIG. 17, according to the present embodiment, each of the contacts 40 is held by and fixed to the fixed housing 20 only at the corresponding holding portion 26. These contacts 40 support the movable housing 30 from below, while each of the contacts 40 has no part which is held by or fixed to the movable housing 30. According to the present embodiment, a movable range of the resiliently deformable portion 46 of each of the contacts 40 can be made wide. Moreover, according to the present embodiment, each of the resiliently deformable portions 46 can be moved relative to the movable housing 30 and the fixed housing 20 while the movable housing 30 is kept at the position shown in FIG. 17 by using a jig (not shown), for example. In other words, each of the resiliently deformable portions 46 is movable relative to the fixed housing 20 with no movement of the movable housing 30 relative to the fixed housing 20.

The movable housing 30 can be moved upward from the position shown in FIG. 17 to a position at which the restricted portions 36 (see FIG. 15) are brought into abutment with the movement restriction portions 244 (see FIG. 15) while each of the contacts 40 is kept at the position shown in FIG. 17 by using a jig (not shown), for example. In other words, the movable housing 30 is movable relative to the fixed housing 20 with no movement of each of the resiliently deformable portions 46 relative to the fixed housing 20.

Referring to FIG. 17, each of the resiliently deformable portions 46 of the contacts 40 is, at least in part, accommodated in the corresponding contact-accommodation portion 352 under the separated state. In detail, each of the resiliently deformable portions 46 has an accommodated portion 48. Each of the accommodated portions 48 is a part which is located in the corresponding contact-accommodation portion 352 under a state where any part and any member of the connector 10 are applied with no force except the force due to their own weights. In other words, each of the accommodated portions 48 is accommodated in the corresponding contact-accommodation portion 352 under the separated state shown in FIG. 17. Under the separated state, the contact portion 474 of each of the contacts 40 is located in the corresponding receiving portion 38 and is movable in the X-direction in accordance with resilient deformation of the resiliently deformable portion 46.

Figure 3:
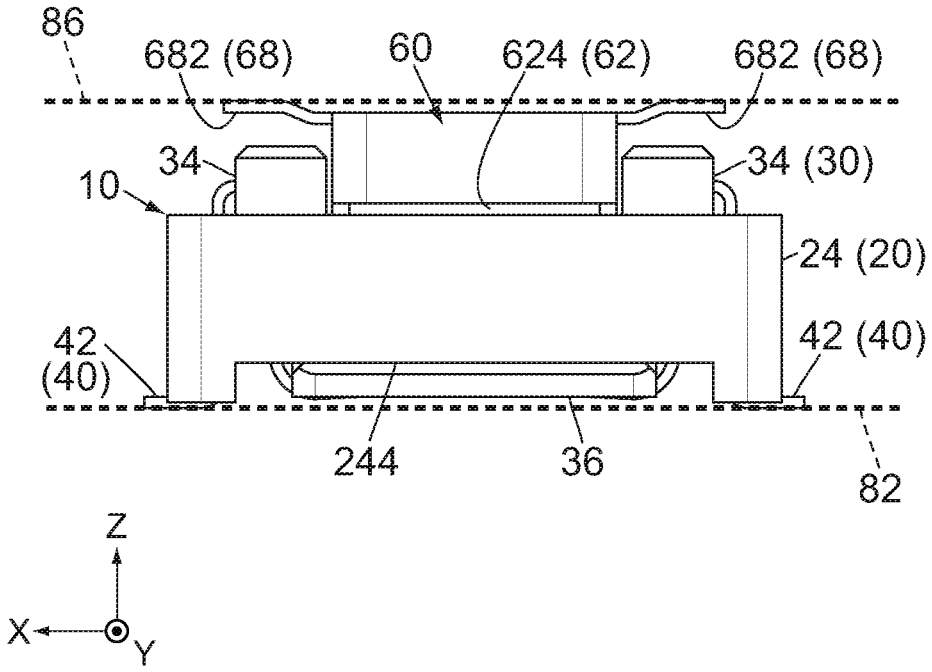
FIG. 3 is a side view showing the connector and the mating connector of FIG. 2, wherein a part of a circuit board, on which the connector is mounted, and a part of a mating circuit board, on which the mating connector is mounted, are illustrated with dashed line.
Figure 4:
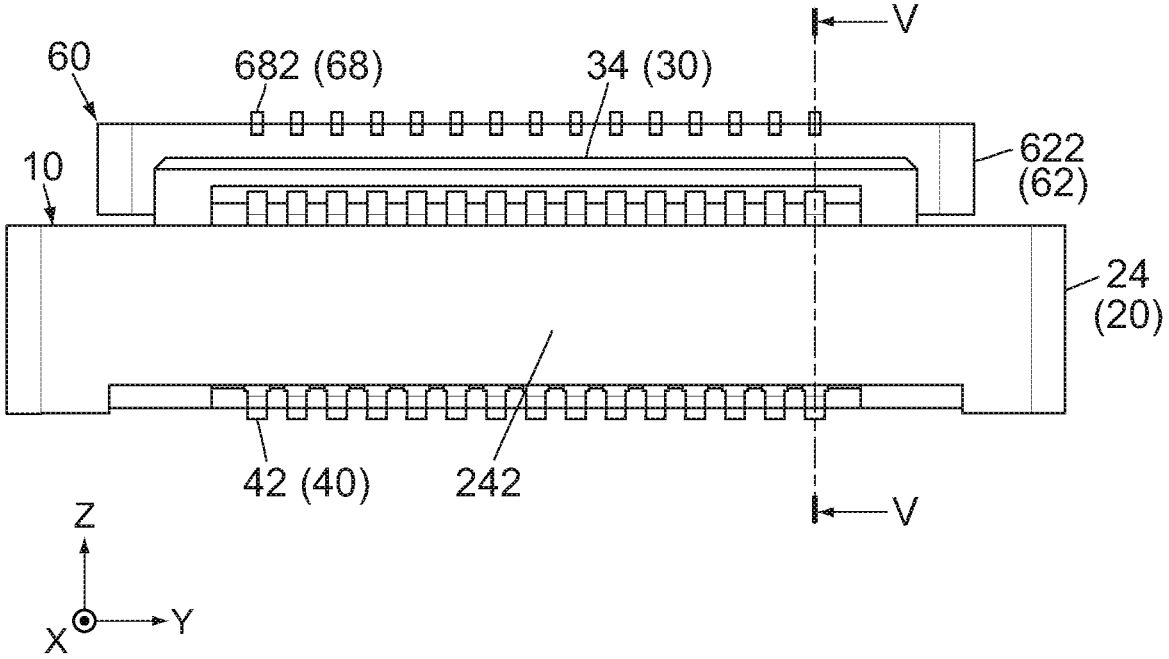
FIG. 4 is another side view showing the connector and the mating connector of FIG. 2.

Referring to FIGS. 3 and 5, when the mating connector 60 is mated with the connector 10 without moving the movable housing 30 in the X-direction from the position under the separated state (see FIGS. 15 and 17), the contact portion 474 of each of the contacts 40 is brought into contact with the mating contact portion 684 of the corresponding mating contact 68 with predetermined sufficient contact pressure. As a result, the connector 10 and the mating connector 60 are electrically connected with each other.

Referring to FIG. 17, according to the present embodiment, the accommodated portion 48 of each of the resiliently deformable portions 46 is, at least in part, located right under the top plate 326. In addition, each of the resiliently deformable portions 46 is partially located right under the corresponding additional top plate 346. Referring to FIG. 5, according to this structure, when the mating connector 60 is removed from the connector 10, each of the resiliently deformable portions 46 cannot be moved upward beyond the top plate 326 and the corresponding additional top plate 346. This structure of the present embodiment prevents damage of the contact 40 which might occur because of excessive resilient deformation of the resiliently deformable portion 46. However, the present invention is not limited thereto. Each of the top plate 326 and the additional top plates 346 may be provided as necessary.

Figure 7:
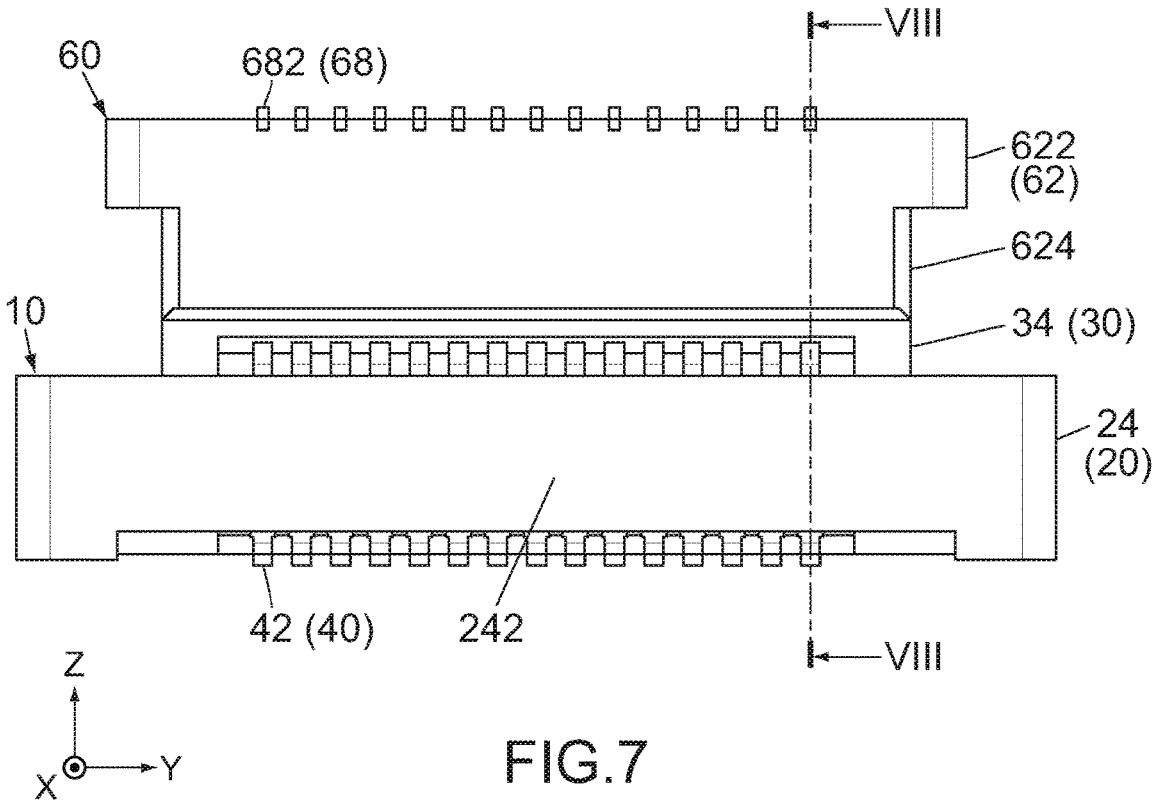
FIG. 7 is another side view showing the connector and the mating connector of FIG. 4, wherein the connector is in a process of being mated with the mating connector.
Figure 8:
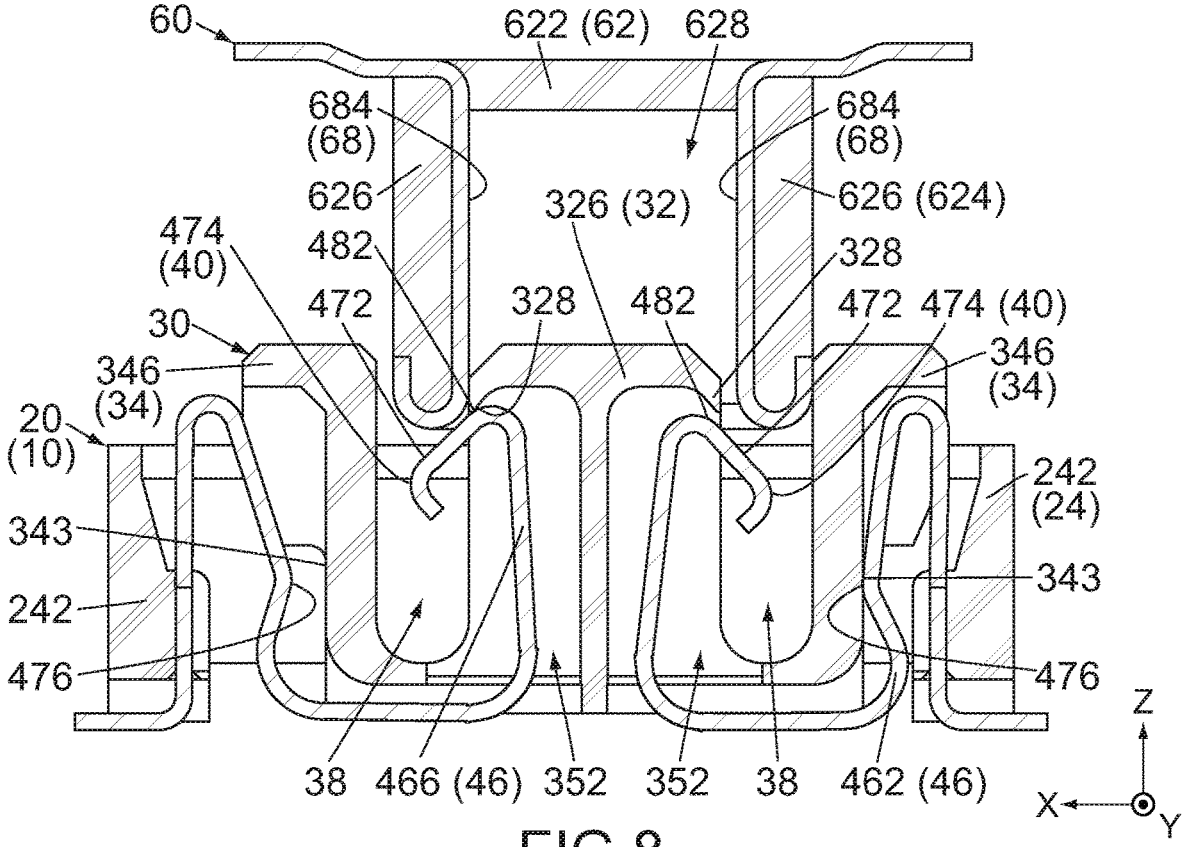
FIG. 8 is a cross-sectional view showing the connector and the mating connector of FIG. 7, taken along line VIII-VIII.

Referring to FIGS. 7 and 8, if the position of the mating connector 60 in the X-direction is shifted with respect to the middle position of the fixed housing 20 in the X-direction during a mating process of the mating connector 60 with the connector 10, the mating connector 60 pushes the movable housing 30 along the X-direction, so that the movable housing 30 is moved relative to the fixed housing 20 along the X-direction. In other words, the movable housing 30 is displaced in the X-direction.

Referring to FIG. 17, the top plate 326 of the present embodiment has two end portions 327 which correspond to the receiving portions 38, respectively, and two regulation portions 328 which correspond to the end portions 327, respectively. The end portions 327 are located at opposite ends of the top plate 326 in the X-direction and face the two receiving portions 38 in the X-direction, respectively. Thus, each of the end portions 327 and the corresponding receiving portion 38 are adjacent to each other in the X-direction. Each of the regulation portions 328 extends downward from the corresponding end portion 327. Each of the accommodated portions 48 has a regulated portion 482 corresponding to one of the regulation portions 328. Under the separated state, each of the regulation portions 328 is located between the corresponding regulated portions 482 and the corresponding receiving portion 38 in the X-direction and regulates movements of the corresponding regulated portions 482 toward the corresponding receiving portion 38.

More specifically, referring to FIG. 8, when the movable housing 30 is displaced in the X-direction, the regulated portion 482 of one of the two contacts 40 located at positions same as each other in the Y-direction, for example, the regulated portion 482 of the positive X-side contact 40 in FIG. 8, is brought into contact with the corresponding regulation portion 328 of the movable housing 30 and is moved in the X-direction together with the regulation portion 328. According to the present embodiment, the movement regulation by the regulation portions 328 provided on the top plate 326 prevents the resiliently deformable portions 46 from being damaged. In detail, damage of the resiliently deformable portions 46, which might occur when an upper end of the inner portion 466 of each of the resiliently deformable portions 46 is moved into the receiving portion 38, is prevented. However, the present invention is not limited thereto. For example, each of the regulation portions 328 does not need to be a part of the top plate 326. Moreover, the regulation portions 328 may be provided as necessary.

Figure 6:
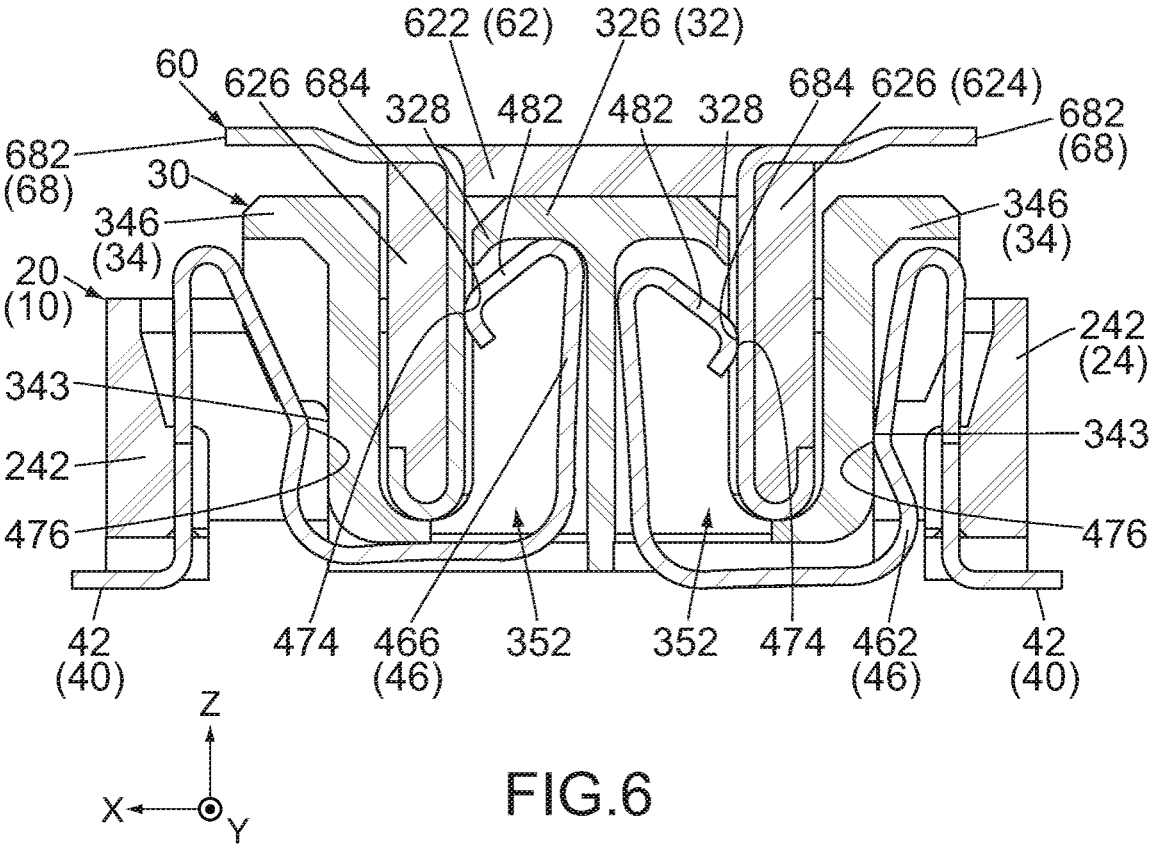
FIG. 6 is another cross-sectional view showing the connector and the mating connector of FIG. 5, wherein a movable housing of the connector is moved from the position shown in FIG. 5 along a width direction.

Referring to FIG. 6, according to the present embodiment, as a result of the movement regulation by the regulation portions 328, the resiliently deformable portion 46 of each of the contacts 40 in one of the two rows in the X-direction, for example, the resiliently deformable portion 46 of the positive X-side contact 40 in FIG. 6, follows a movement of the movable housing 30 in the X-direction and is resiliently deformed so as to extend in the X-direction. As a result, when the connector 10 and the mating connector 60 are mated with each other under a state where the movable housing 30 is displaced in the X-direction, the contact portion 474 of each of the contacts 40 in the one of the two rows in the X-direction is brought into contact with the mating contact portion 684 of the corresponding mating contact 68 with sufficient contact pressure including a force toward its initial position.

Referring to FIG. 17, according to the present embodiment, the facing portion 476 of each of the contacts 40 is located between the held portion 44 and the corresponding catching portion 343 in the X-direction. Referring to FIG. 8, according to this arrangement, when the movable housing 30 is moved along the X-direction, one of the catching portions 343 pushes the facing portion 476 of a remaining one of the two contacts 40 located at positions same as each other in the Y-direction, for example, the facing portion 476 of the negative X-side contact 40 in FIG. 8, outward in the X-direction.

More specifically, when the movable housing 30 is displaced in the X-direction, the facing portion 476 of the remaining one of the two contacts 40 located at positions same as each other in the Y-direction, for example, the facing portion 476 of the negative X-side contact 40 in FIG. 8, is moved in the X-direction while being pressed against the catching portion 343 of the movable housing 30 but being kept to be movable on the catching portion 343 of the movable housing 30. Referring to FIG. 6, this structure works to prevent decrease of the contact pressure at the contact portion 474 of each of the contacts 40 in a remaining one of the two rows in the X-direction, for example, at the contact portion 474 of the negative X-side contact 40 in FIG. 6. Thus, when the connector 10 and the mating connector 60 are mated with each other under the state where the movable housing 30 is displaced in the X-direction, the contact portion 474 of each of the contacts 40 in the remaining one of the two rows in the X-direction is also brought into contact with the mating contact portion 684 of the corresponding mating contact 68 with sufficient contact pressure.

According to the present embodiment, the facing portion 476 of each of the contacts 40 is kept to be movable at least in the Z-direction when pressed against the catching portion 343 in accordance with a relative movement of the movable housing 30. In other words, a movement of the movable housing 30 relative to the fixed housing 20 enables the facing portions 476 to be pressed against the catching portion 343 while allowing movements of the facing portions 476 at least in the Z-direction.

According to the aforementioned structure, even in a case where the movable housing 30 is moved relative to the fixed housing 20, the resiliently deformable portion 46 keeps its spring characteristics, so that the contact portion 474 can be in contact with the mating contact 68 with sufficient contact pressure. The thus-formed single resiliently deformable portion 46 can be used both as a spring portion for floating and another spring portion for contact without fixing the contact 40 to the movable housing 30, so that the size of the connector 10, particularly the size thereof in the X-direction, can be reduced. Thus, the present embodiment provides a new structure which enables reduction of the size of the floating connector.

In addition, referring to FIG. 17, according to the present embodiment, each of the receiving portions 38 of the movable housing 30 is, at least in part, located in the housing-accommodation portion 28 of the fixed housing 20. According to this arrangement, the connector 10 can be reduced in size in the Z-direction. As shown in FIGS. 15 and 17, according to the movable housing 30 of the present embodiment, an upper part (positive Z-side part) of the body portion 32 and upper parts of the outer walls 34 project upward from the housing-accommodation portion 28. However, the present invention is not limited thereto. The movable housing 30 may be entirely located in the housing-accommodation portion 28. According to this structure, the connector 10 can be further reduced in size in the Z-direction. However, the present invention is not limited thereto. The movable housing 30 may be, at least in part, accommodated in the housing-accommodation portion 28.

Referring to FIG. 17, according to the present embodiment, the facing portion 476 of each of the contacts 40 is in contact with the corresponding catching portion 343 under the separated state. However, the facing portion 476 of each of the contacts 40 may be apart from the corresponding catching portion 343 under the separated state, provided that the facing portion 476 is brought into abutment with and is caught by the corresponding catching portion 343 in accordance with a movement of the movable housing 30 relative to the fixed housing 20. Thus, each of the facing portions 476 may be in contact with the corresponding catching portion 343 or may face the corresponding catching portion 343 at a distance apart therefrom in the X-direction.

Referring to FIG. 6, according to the present embodiment, the facing portion 476 is a projection projecting inward in the X-direction, and the catching portion 343 is a planar portion. The facing portion 476 is movable on the catching portion 343 so as to slide thereon and is pivotable so as to change its inclination angle with respect to the catching portion 343. In other words, the catching portion 343 is pivotable on the projection (facing portion 476) and is movable on the facing portion 476 so as to slide thereon. This support structure, in which rotational support and movable support are combined, works to more reliably prevent decrease of the contact pressure at the contact portion 474 of each of the contacts 40 in the remaining one of the two rows in the X-direction, for example, at the contact portion 474 of the negative X-side contact 40 in FIG. 6, even when the movable housing 30 is displaced in the X-direction.

However, the present invention is not limited to the aforementioned structure. For example, the catching portion 343 may be a projection projecting outward in the X-direction, and the facing portion 476 may be a linearly extending portion. Thus, one of the facing portion 476 and the catching portion 343 may be a projection. Meanwhile, a remaining one of the facing portion 476 and the catching portion 343 may be pivotable on the projection and may be movable on the projection so as to slide thereon. Moreover, each of the facing portion 476 and the catching portion 343 may be a planar portion.

Referring to FIGS. 1 and 10, according to the present embodiment, while the mating connector 60 is mated with the connector 10, the body portion 32 is received into the mating receiving portion 628 so that the mating housing 62 is positioned relative to the movable housing 30 in the XY-plane. Thus, the body portion 32 of the present embodiment works as a positioning portion which positions the mating connector 60. In particular, the two end plates 321 of the body portion 32 position the mating connector 60 in the Y-direction. However, the present invention is not limited thereto. For example, a part other than the body portion 32 may work as the positioning portion. Thus, the end plates 321 may be provided as necessary.

Referring to FIG. 18, according to the present embodiment, adjacent two of the contacts 40 in the Y-direction are separated from each other by one of the partitions 354. Each of the partitions 354 prevents the contacts 40 arranged in the Y-direction from being brought into contact with each other. In addition, while the mating connector 60 (see FIG. 1) is mated with the connector 10, each of the contacts 40 is positioned relative to the corresponding mating contact 68 (see FIG. 1) by the partitions 354 and the end plates 321. However, the partitions 354 do not need to be provided in such a case where each of the contacts 40 is sufficiently large in the Y-direction, and adjacent two of the contacts 40 in the Y-direction are sufficiently apart from each other.

According to the present embodiment, the two contacts 40 which are located at positions same as each other in the Y-direction are separated from each other by the separation portion 324. Thus, the two rows of the contacts 40 separated in the X-direction are prevented by the separation portion 324 from being brought into contact with each other. However, the separation portion 324 may be provided as necessary.

The present invention is not limited to the already described embodiment and modifications but is various applicable. Hereafter, explanation will be made about a second embodiment and a third embodiment of the present invention and mainly made about differences from the first embodiment. Each of the embodiments described below can be modified as described in the embodiment and can be modified similarly to the modifications in other embodiments including the first embodiment.

Second Embodiment

Figure 19:
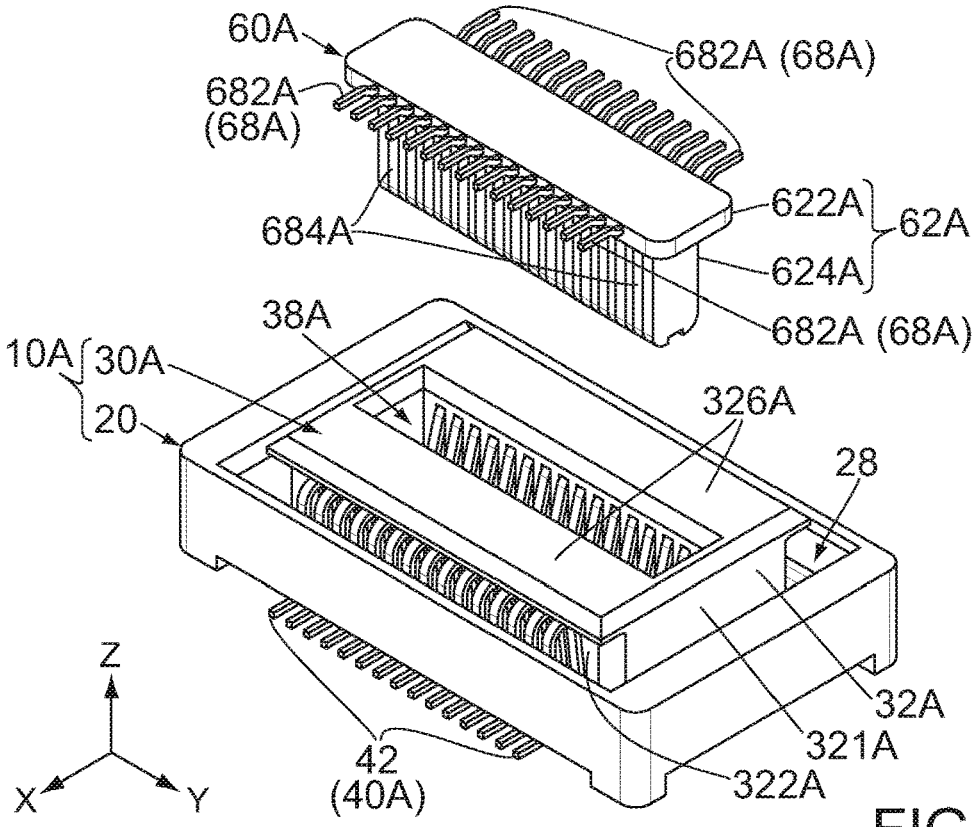
FIG. 19 is a perspective view showing a connector and a mating connector according to a second embodiment of the present invention, wherein the connector and the mating connector are separated from each other.
Figure 20:
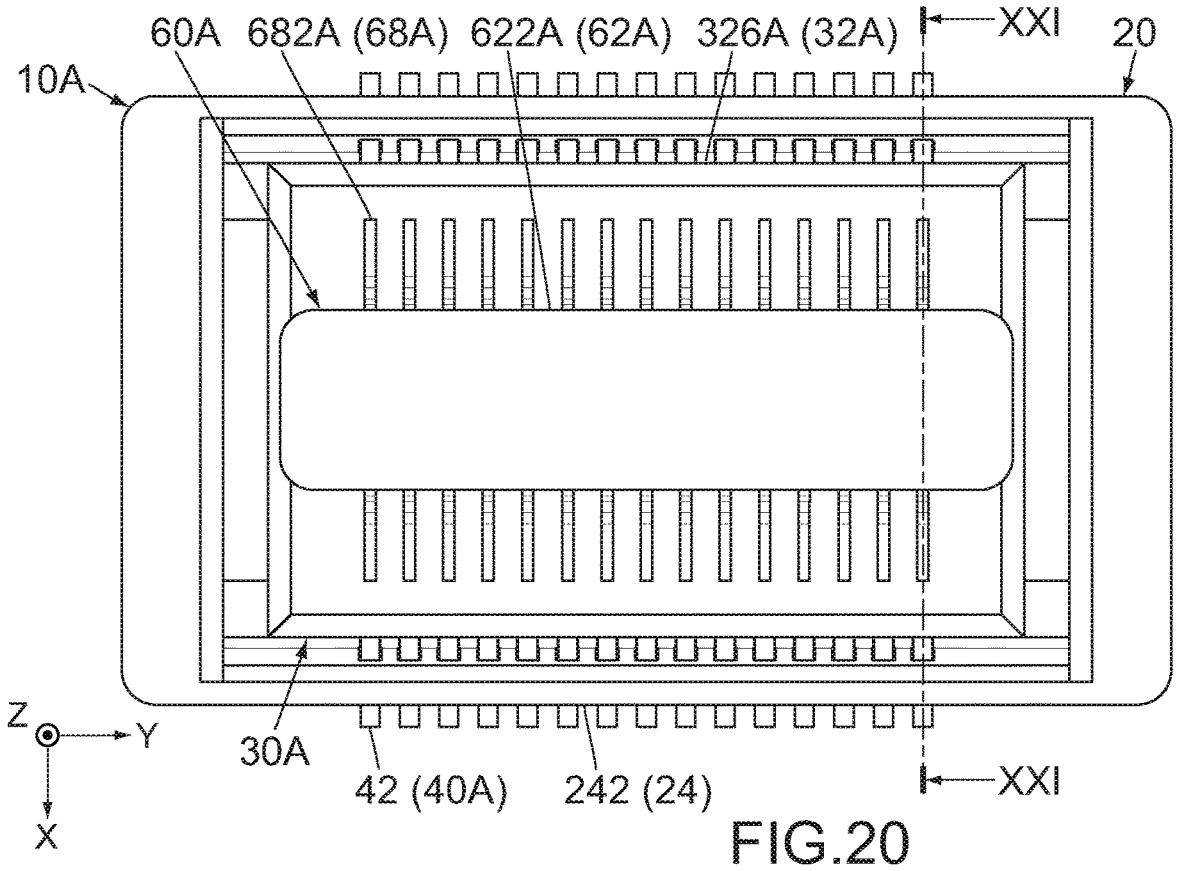
FIG. 20 is a plan view showing the connector and the mating connector of FIG. 19, wherein the connector and the mating connector are mated with each other.

Referring to FIGS. 19 and 20, a connector 10A according to the second embodiment of the present invention is mateable with a mating connector 60A along an upper-lower direction (Z-direction: mating direction). The mating connector 60A mated with the connector 10A is removable from the connector 10A along the Z-direction. In the present embodiment, the connector 10A is a receptacle and is an on-board connector which is to be mounted on the circuit board 82 (see FIG. 23). The mating connector 60A is a plug and is another on-board connector which is to be mounted on the mating circuit board 86 (see FIG. 23).

Figure 24:
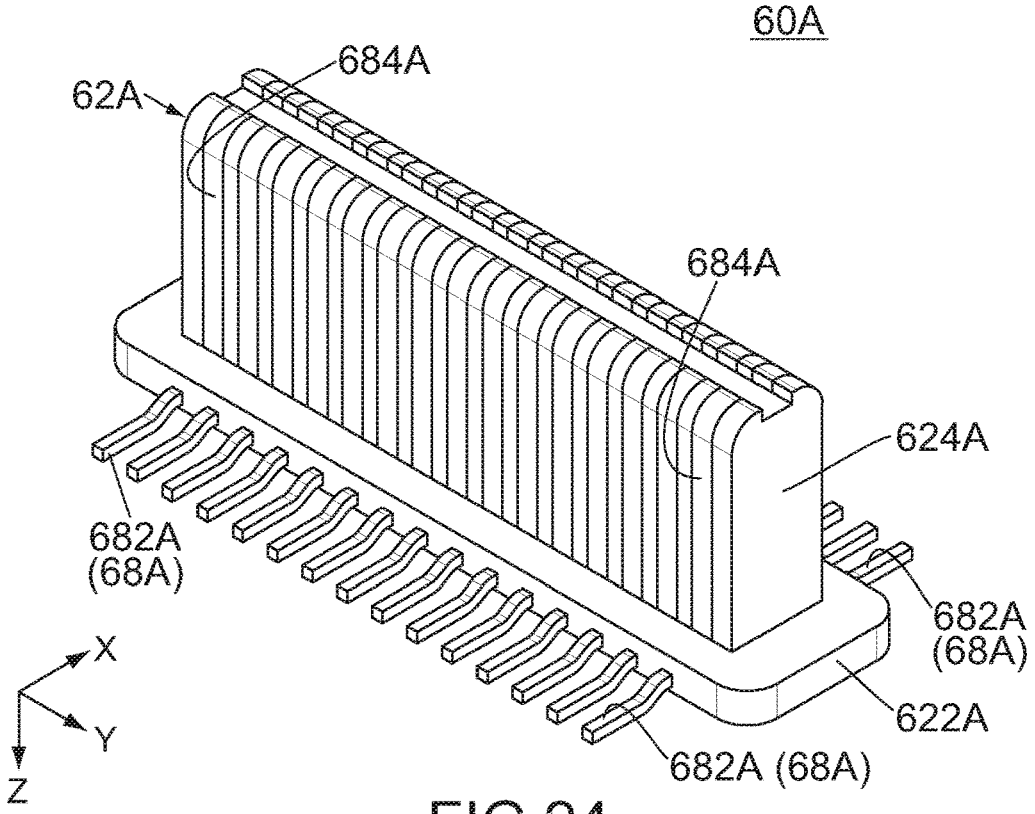
FIG. 24 is a perspective view showing the mating connector of FIG. 19.

Referring to FIGS. 19 and 24, the mating connector 60A comprises a mating housing 62A made of insulator and a plurality of mating contacts 68A each made of conductor. The mating housing 62A has a base portion 622A similar to the base portion 622 (see FIG. 9) and a mating body portion 624A. The mating body portion 624A extends away from the base portion 622A in the Z-direction. The mating body portion 624A has opposite side portions in a width direction (X-direction) perpendicular to the Z-direction. Each of the side portions of the mating body portion 624A extends along the YZ-plane.

The mating contacts 68A have shapes same as one another and are grouped into two rows in the X-direction. The two rows of the mating contacts 68A correspond to the side portions of the mating body portion 624A in the X-direction, respectively. The two rows of the mating contacts 68A are arranged to be mirror images of each other with respect to the YZ-plane. The mating contacts 68A of each row are held by the corresponding side portion of the mating body portion 624A and are arranged at regular intervals in a pitch direction (Y-direction) perpendicular to both the X-direction and the Z-direction.

Figure 23:
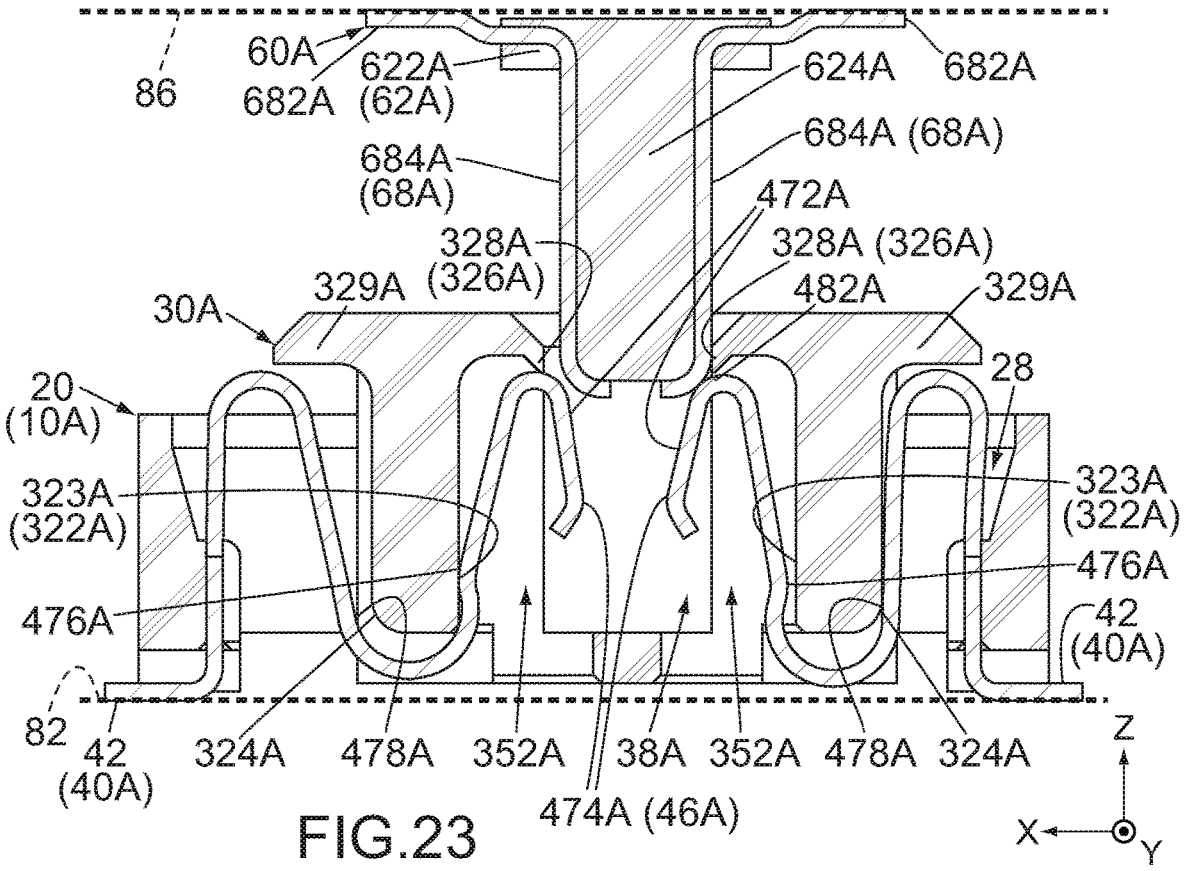
FIG. 23 is another cross-sectional view showing the connector and the mating connector of FIG. 22, wherein the connector is in a process of being mated with the mating connector, and a part of a circuit board, on which the connector is mounted, and a part of a mating circuit board, on which the mating connector is mounted, are illustrated with dashed line.

Referring to FIGS. 19 and 23, each of the mating contacts 68A is a single metal plate with bends and has a mating contact portion 684A and a mating fixed portion 682A which is to be fixed on the mating circuit board 86 similarly to the mating fixed portion 682 (see FIG. 9). Each of the mating fixed portions 682A is partially embedded in the base portion 622A and projects outward in the X-direction from the base portion 622A. Each of the mating contact portions 684A is embedded in the corresponding side portion of the mating body portion 624A and extends along the Z-direction while being partially exposed outward from the mating body portion 624A.

The mating connector 60A of the present embodiment has the aforementioned structure. However, the structure of the mating connector 60A can be modified in accordance with the structure of the connector 10A.

Referring to FIGS. 19 and 25 to 27, the connector 10A comprises the fixed housing 20 same as that of the connector 10 (see FIG. 13), a movable housing 30A made of insulator and a plurality of contacts 40A each of which is made of conductor and which correspond to the mating contacts 68A, respectively. Hereafter, explanation will be made about the structure of each member of the connector 10A.

Figure 26:
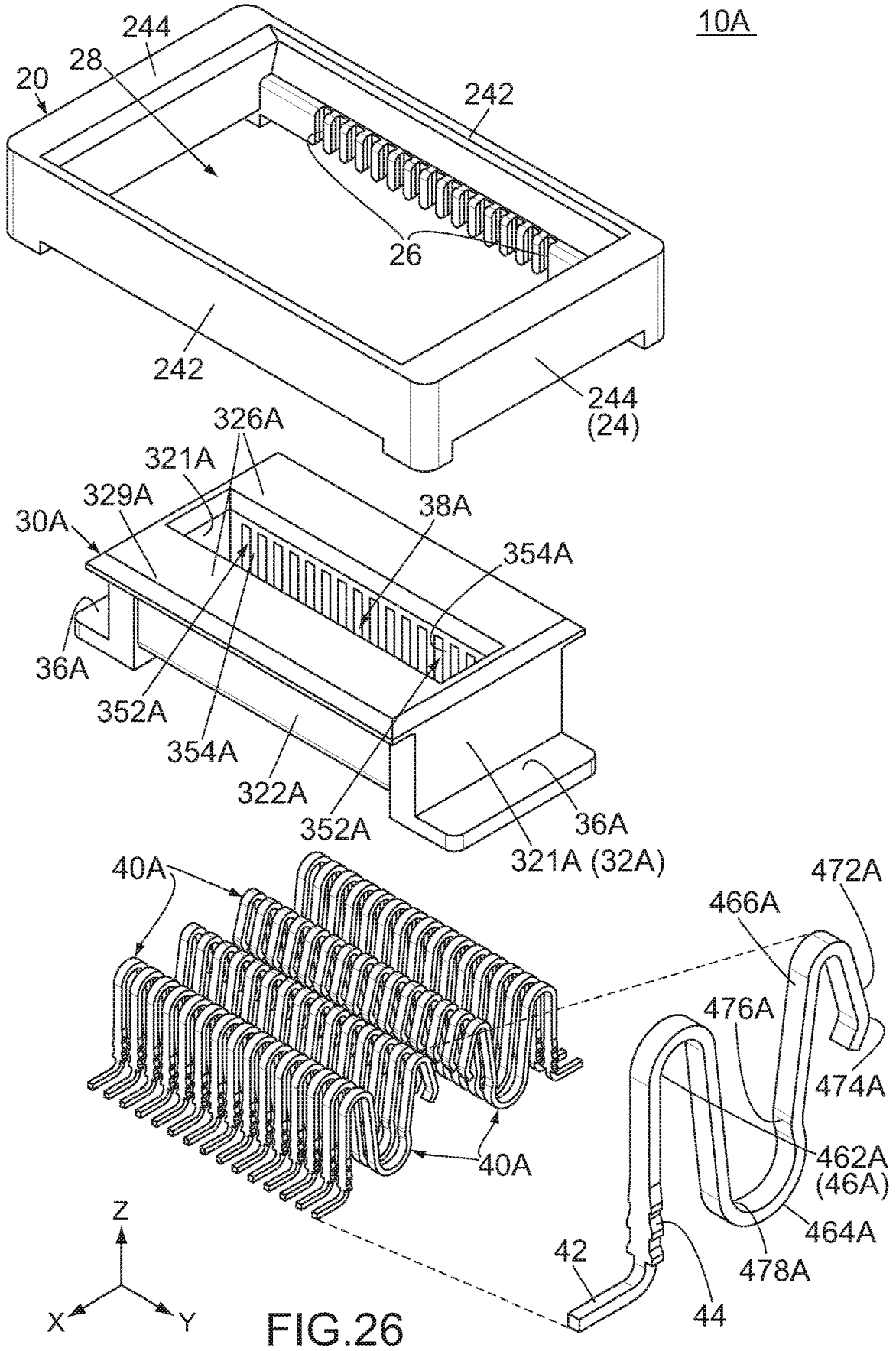
FIG. 26 is an exploded perspective view showing the connector of FIG. 19, wherein one of contacts is enlarged to be illustrated.
Figure 27:
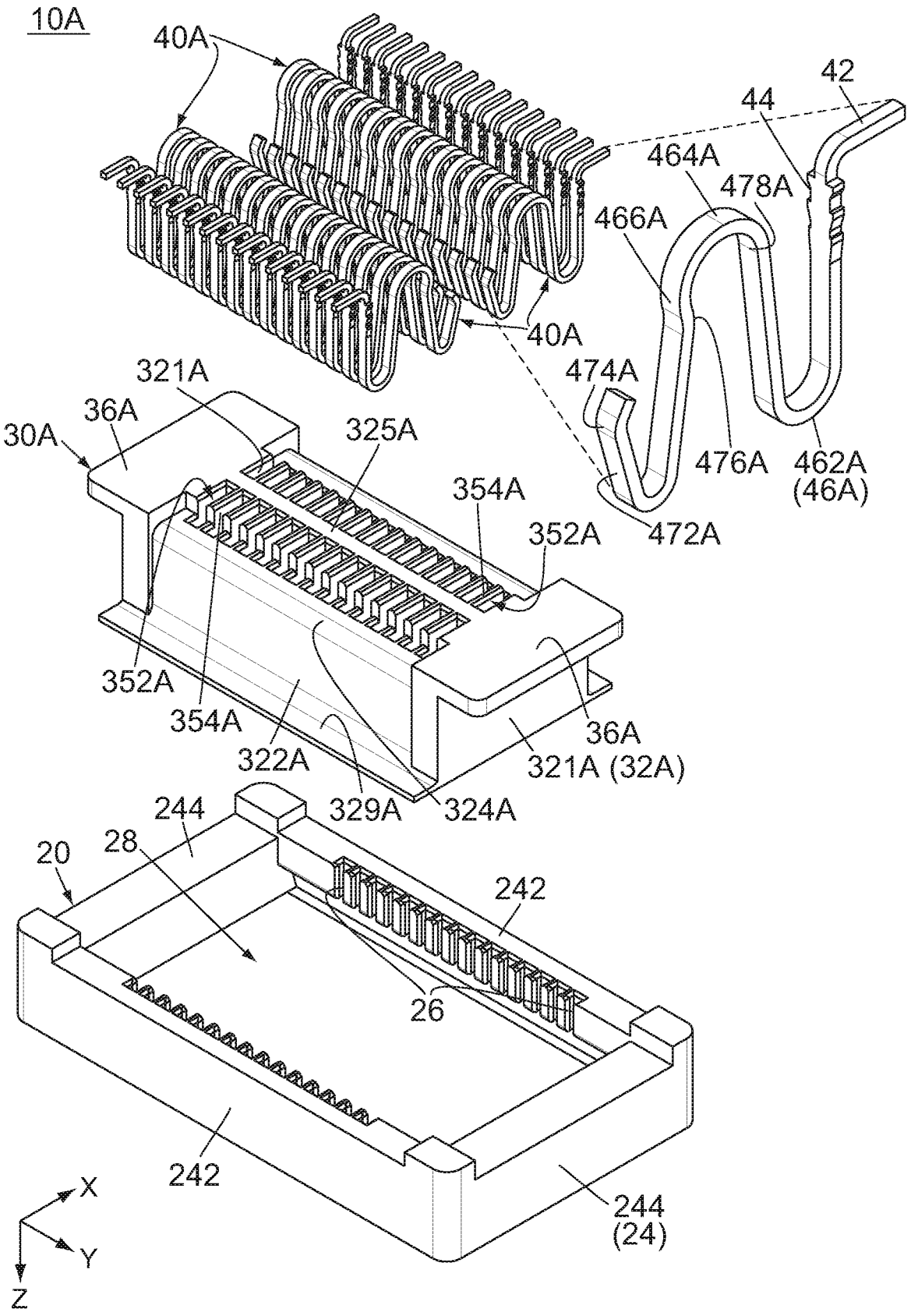
FIG. 27 is an exploded perspective view showing the connector of FIG. 25, wherein one of the contacts is enlarged to be illustrated.

Referring to FIG. 23, the fixed housing 20 is mounted on and fixed to the circuit board 82 when the connector 10A is used. Referring to FIGS. 26 and 27, the fixed housing 20 has the two coupling walls (movement restriction portions) 244, the housing-accommodation portion 28 which opens upward, or opens in the positive Z-direction, and the plurality of the holding portions 26 which correspond to the contacts 40A, respectively. The holding portions 26 are grouped into two rows in the X-direction. The holding portions 26 of each row are arranged in the Y-direction.

Referring to FIGS. 19, 26 and 27, the movable housing 30A of the present embodiment has a body portion 32A and two flanges (restricted portions) 36A. The body portion 32A projects upward from a lower end, or the negative Z-side end, of the movable housing 30A and extends along the Y-direction. The flanges 36A are located at opposite sides of the movable housing 30A in the Y-direction, respectively. Each of the flanges 36A projects outward in the Y-direction from the lower end of the movable housing 30A and has a flat plate shape extending along a horizontal plane (XY-plane).

Referring to FIGS. 26 and 27, the body portion 32A has two end plates 321A, two side plates 322A, a bottom plate 325A and two top plates 326A which correspond to the side plates 322A, respectively. Each of the end plates 321A extends along the XZ-plane. Each of the side plates 322A extends along the YZ-plane. The bottom plate 325A is located at a lower end of the body portion 32A. The bottom plate 325A is located at the middle of the body portion 32A in the X-direction and extends along the Y-direction in an area between the two end plates 321A. Each of the top plates 326A is located at an upper end, or the positive Z-side end, of the corresponding side plate 322A and extends along the XY-plane as a whole. Each of the top plates 326A is provided with an additional top plate 329A. Each of the additional top plates 329A is a protruding part of the top plate 326A which protrudes outward in the X-direction beyond the side plate 322A.

Figure 29:
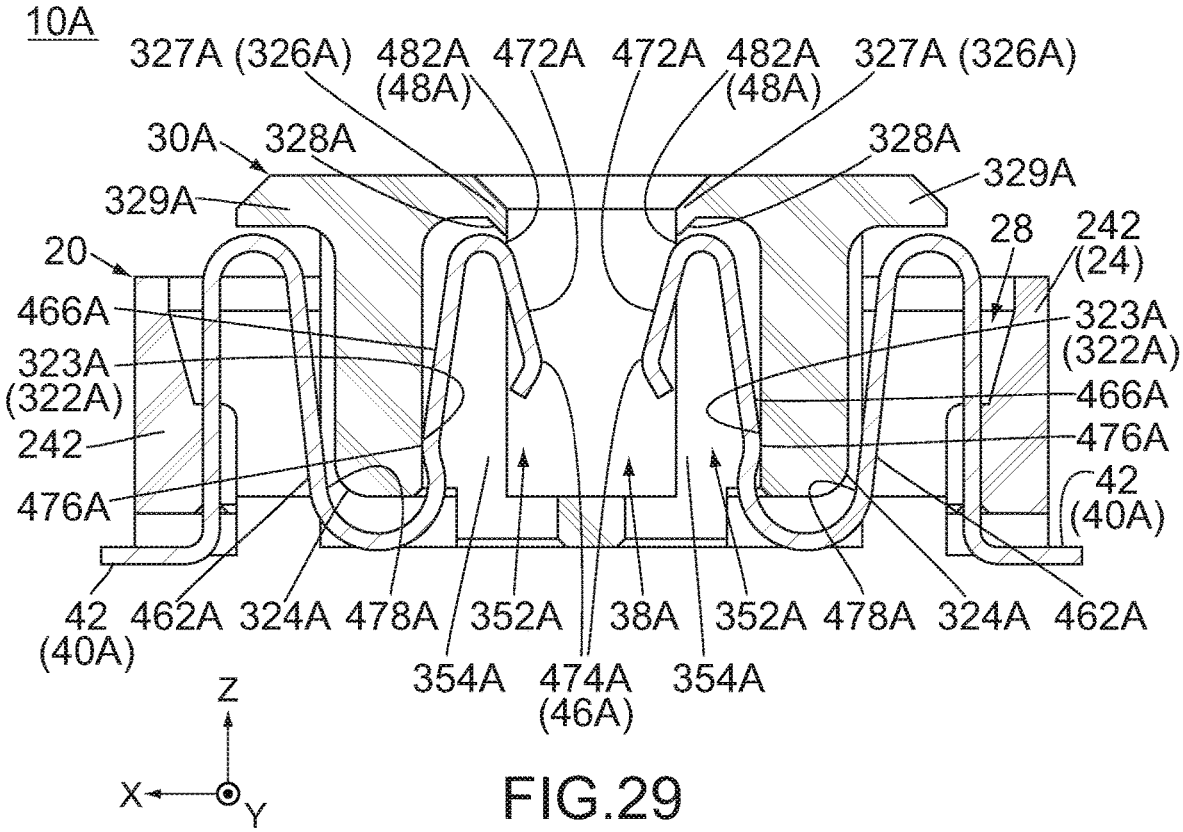
FIG. 29 is a cross-sectional view showing the connector of FIG. 28, taken along line XXIX-XXIX.

Referring to FIG. 29, each of the side plates 322A has an inner surface (catching portion) 323A and an outer lower portion (additional catching portion) 324A. Each of the inner surfaces 323A is an inner surface of the side plate 322A in the X-direction and extends along the YZ-plane. Each of the outer lower portions 324A is a lower end part of an outer part of the side plate 322A in the X-direction and extends along the Y-direction.

As described above, the movable housing 30A of the present embodiment has the two top plates 326A, the two additional top plates 329A which correspond to the top plates 326A, respectively, the two inner surfaces (catching portions) 323A which correspond to the side plates 322A, respectively, the two outer lower portions (additional catching portions) 324A which correspond to the side plates 322A, respectively, and the two flanges (restricted portions) 36A.

Figure 21:
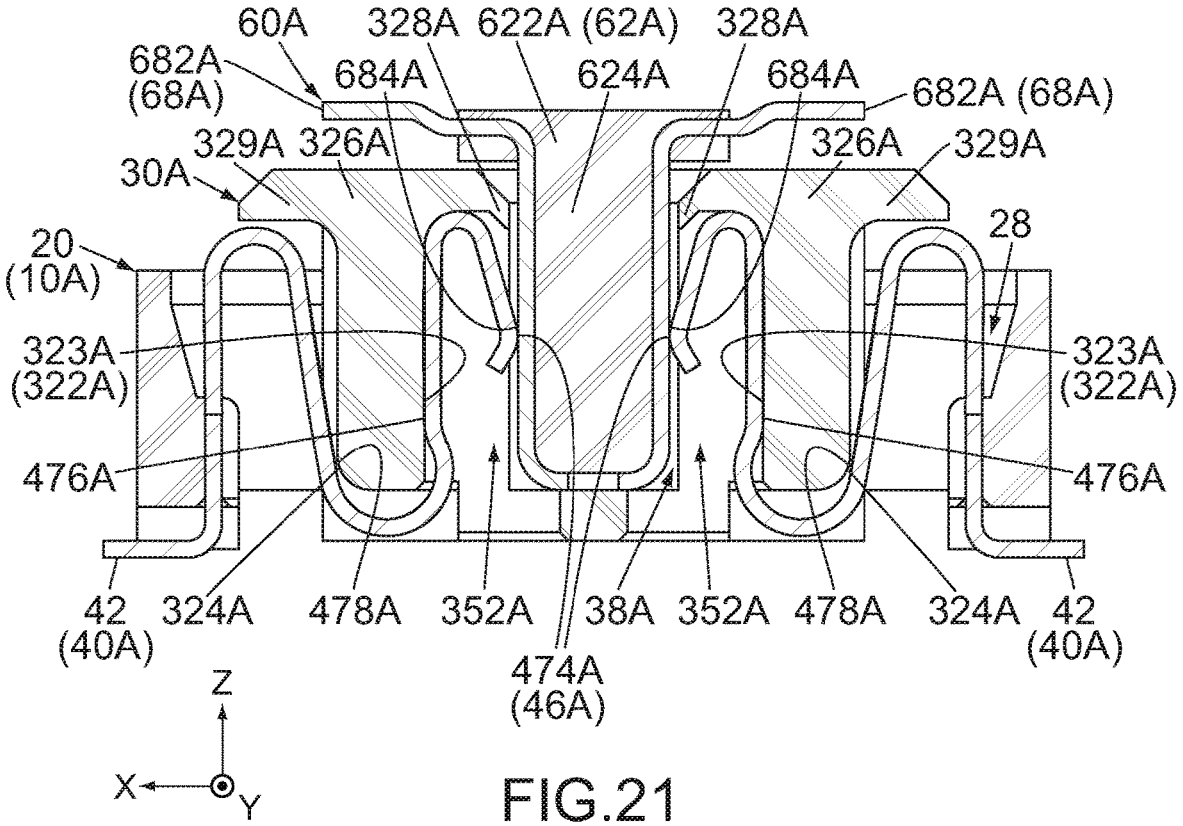
FIG. 21 is a cross-sectional view showing the connector and the mating connector of FIG. 20, taken along line XXI-XXI.
Figure 28:
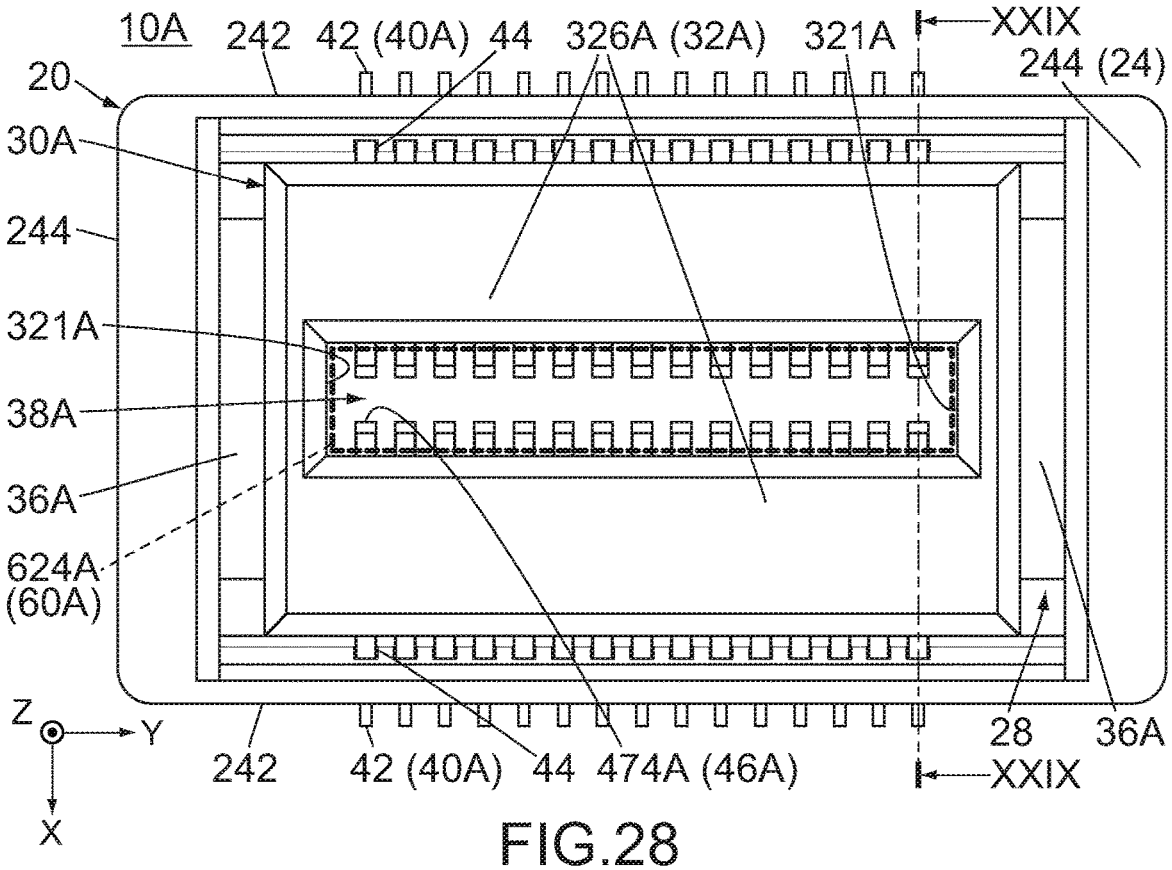
FIG. 28 is a plan view showing the connector of FIG. 19, wherein an outline of a mating body portion of the mating connector mated with the connector is illustrated with dashed line.

Referring to FIGS. 19, 26 and 28, the movable housing 30A has a single receiving portion 38A. The receiving portion 38A is a space which opens upward. Referring to FIG. 21, the receiving portion 38A receives, at least in part, the mating connector 60A under a mated state where the connector 10A and the mating connector 60A are mated with each other. More specifically, the receiving portion 38A of the present embodiment partially receives the mating body portion 624A of the mating connector 60A under the mated state. Referring to FIG. 29, the receiving portion 38A is located between the two side plates 322A in the X-direction.

Referring to FIGS. 26 and 27, the movable housing 30A has a plurality of contact-accommodation portions 352A which correspond to the contacts 40A, respectively, and one or more of partitions 354A.

Each of the contact-accommodation portions 352A is a space which opens downward. The contact-accommodation portions 352A are grouped into two rows in the X-direction. The two rows of the contact-accommodation portions 352A correspond to the two side plates 322A, respectively. The contact-accommodation portions 352A of each row have shapes same as one another and are arranged at regular intervals in the Y-direction. The two rows of the contact-accommodation portions 352A are arranged to be mirror images of each other with respect to the YZ-plane. Referring to FIGS. 27 and 29, each of the contact-accommodation portions 352A extends between the inner surface 323A of the corresponding side plate 322A and the receiving portion 38A in the X-direction while having a constant size in the Y-direction. Each of the contact-accommodation portions 352A communicates with the receiving portion 38A in the X-direction. In detail, each of the contact-accommodation portions 352A is located under the top plate 326A of the corresponding side plate 322A and is located adjacent to and outward of the receiving portion 38A in the X-direction.

Referring to FIGS. 26 and 27, each of the partitions 354A is located between adjacent two of the contact-accommodation portions 352A in the Y-direction. Referring to FIG. 29, each of the partitions 354A extends between the inner surface 323A of the corresponding side plate 322A and the receiving portion 38A in the X-direction.

The contact-accommodation portions 352A and the partitions 354A of the present embodiment are formed and arranged as described above. However, the structure and the arrangement of the contact-accommodation portions 352A and the partitions 354A can be variously modified. For example, the movable housing 30A may have only one row of the contact-accommodation portions 352A and the partitions 354A arranged in the Y-direction. According to this structure, the number of the contact-accommodation portions 352A may be two, and the number of the partition 354A may be one.

Referring to FIGS. 26 and 27, the contacts 40A have shapes same as one another and are grouped into two rows in the X-direction so as to correspond to the contact-accommodation portions 352A, respectively. The two rows of the contacts 40A are arranged to be mirror images of each other with respect to the YZ-plane. The contacts 40A of each row are arranged at regular intervals in the Y-direction.

Each of the contacts 40A is a single metal plate with bends and has a resiliently deformable portion 46A in addition to the fixed portion 42 which is to be fixed on the circuit board 82 (see FIG. 23) similarly to that of the contact 40 (see FIG. 13) and the held portion 44 which is to be held by the corresponding holding portion 26 similarly to that of the contact 40. The resiliently deformable portion 46A extends and meanders in the XZ-plane so that the resiliently deformable portion 46A is resiliently deformable. In detail, each of the resiliently deformable portions 46A has an outer portion 462A, a bottom portion 464A and an inner portion 466A. The outer portion 462A first extends upward from the upper end of the held portion 44. Then, the outer portion 462A arcuately extends upward and inward in the X-direction and subsequently extends downward. The bottom portion 464A arcuately extends inward in the X-direction from a lower end of the outer portion 462A. The inner portion 466A first extends upward from an inner end of the bottom portion 464A in the X-direction while partially protruding outward in the X-direction. Then, the inner portion 466A extends downward while partially protruding inward in the X-direction.

Each of the inner portions 466A has a guide portion 472A, a contact portion 474A and a facing portion 476A. Each of the outer portions 462A has an additional facing portion 478A. The guide portion 472A extends downward and inward in the X-direction.

Each of the facing portion 476A and the additional facing portion 478A is located between the held portion 44 and the contact portion 474A in the X-direction. The contact portion 474A and the facing portion 476A are located at positions different from each other in the Z-direction and face in opposite directions in the X-direction. In the present embodiment, the contact portion 474A faces inward in the X-direction, and the facing portion 476A faces outward in the X-direction. In other words, the contact portion 474A and the facing portion 476A protrude so as to apart from each other in the X-direction. In contrast, the contact portion 474A and the additional facing portion 478A face in the same direction, or in a common direction, in the X-direction. More specifically, the additional facing portion 478A is located at a position different from that of the contact portion 474A in the Z-direction and faces inward in the X-direction similarly to the contact portion 474A. Each of the resiliently deformable portions 46A of the present embodiment is provided with the contact portion 474A, the facing portion 476A and the additional facing portion 478A which are formed as described above.

Figure 25:
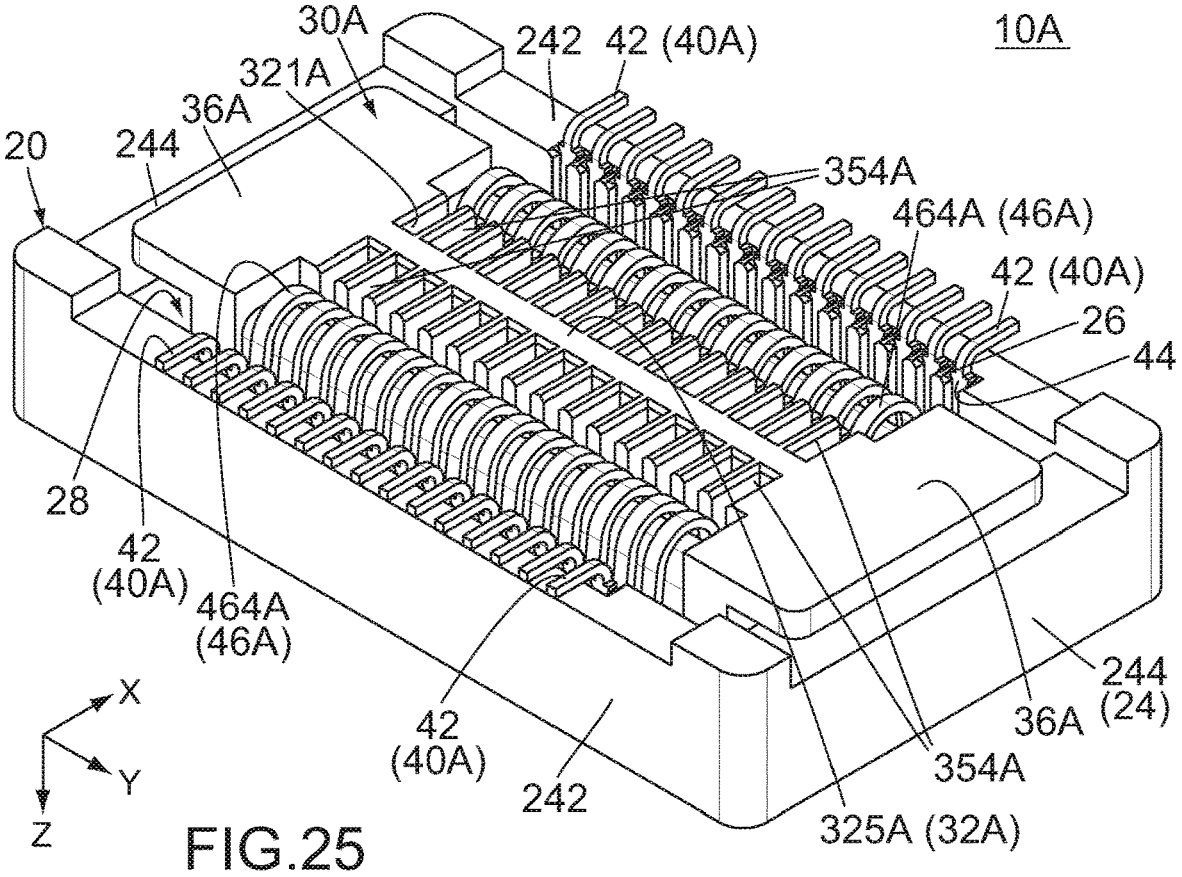
FIG. 25 is a perspective view showing the connector of FIG. 19.

Referring to FIGS. 25 to 27, in the present embodiment, the aforementioned members are combined similarly to those of the connector 10 (see FIG. 13), so that the connector 10A is formed. First, the movable housing 30A is inserted into the housing-accommodation portion 28 of the fixed housing 20 from below. Then, each of the contacts 40A is attached to the fixed housing 20 from below. Referring to FIGS. 27 and 29, for each of the resiliently deformable portions 46A of the thus-attached contacts 40A, the inner portion 466A is inserted and partially accommodated in the corresponding contact-accommodation portion 352A, and the outer portion 462A is arranged outward of the corresponding side plate 322A in the X-direction. As described above, the connector 10A of the present embodiment can be easily formed only by combining the movable housing 30A and the contacts 40A to the fixed housing 20 from below.

Hereafter, explanation will be made about the structure of the connector 10A which is assembled as described above.

Referring to FIGS. 25, 28 and 29, in the XY-plane, a part of the movable housing 30A is located in the housing-accommodation portion 28 of the fixed housing 20 while being apart from the peripheral wall 24. In addition, referring to FIGS. 25 and 28, the two restricted portions 36A are located under and apart from the two movement restriction portions 244 of the fixed housing 20, respectively. The thus-arranged movable housing 30A is movable relative to the fixed housing 20 along the Z-direction and is movable relative to the fixed housing 20 along the XY-plane. Moreover, the movement restriction portions 244 are located above the restricted portions 36A, respectively, and restrict an upward movement of the movable housing 30A relative to the fixed housing 20 within a predetermined range. In addition, the peripheral wall 24 restricts another movement of the movable housing 30A relative to the fixed housing 20 along the XY-plane within another predetermined range. Thus, the connector 10A is a floating connector similar to the connector 10 (see FIG. 12).

Referring to FIG. 29, according to the present embodiment, each of the contacts 40A is held by and fixed to the fixed housing 20 only at the corresponding holding portion 26. Each of the contacts 40A has no part which is held by or fixed to the movable housing 30A. According to the present embodiment, a movable range of the resiliently deformable portion 46A of each of the contacts 40A can be made wide. Moreover, each of the resiliently deformable portions 46A according to the present embodiment is, similarly to the resiliently deformable portion 46 (see FIG. 17), movable relative to the fixed housing 20 with no movement of the movable housing 30A relative to the fixed housing 20. In addition, the movable housing 30A is, similarly to the movable housing 30 (see FIG. 17), movable relative to the fixed housing 20 with no movement of each of the resiliently deformable portions 46A relative to the fixed housing 20.

Each of the resiliently deformable portions 46A of the contacts 40A is, at least in part, accommodated in the corresponding contact-accommodation portion 352A under a separated state (see FIG. 19) where the connector 10A and the mating connector 60A (see FIG. 19) are separated from each other. In detail, each of the resiliently deformable portions 46A has an accommodated portion 48A. Each of the accommodated portions 48A is a part which is located in the corresponding contact-accommodation portion 352A under a state where any part and any member of the connector 10A are applied with no force except the force due to their own weights. In other words, each of the accommodated portions 48A is accommodated in the corresponding contact-accommodation portion 352A under the separated state shown in FIG. 29. Under the separated state, the contact portion 474A of each of the contacts 40A is located in the receiving portion 38A and is movable in the X-direction in accordance with resilient deformation of the resiliently deformable portion 46A.

Referring to FIG. 21, when the mating connector 60A is mated with the connector 10A without moving the movable housing 30A in the X-direction from the position under the separated state (see FIG. 29), the contact portion 474A of each of the contacts 40A is brought into contact with the mating contact portion 684A of the corresponding mating contact 68A with predetermined sufficient contact pressure. As a result, the connector 10A and the mating connector 60A are electrically connected with each other.

Referring to FIG. 29, according to the present embodiment, the accommodated portion 48A of each of the resiliently deformable portions 46A is, at least in part, located right under the corresponding top plate 326A. In addition, each of the resiliently deformable portions 46A is partially located right under the corresponding additional top plate 329A. Referring to FIG. 21, according to this structure, when the mating connector 60A is removed from the connector 10A, each of the resiliently deformable portions 46A cannot be moved upward beyond the corresponding top plate 326A and the corresponding additional top plate 329A. This structure of the present embodiment prevents damage of the contact 40A which might occur because of excessive resilient deformation of the resiliently deformable portion 46A.

Referring to FIG. 23, if the position of the mating connector 60A in the X-direction is shifted with respect to the middle position of the fixed housing 20 in the X-direction during a mating process of the mating connector 60A with the connector 10A, the mating connector 60A pushes the movable housing 30A along the X-direction, so that the movable housing 30A is moved relative to the fixed housing 20 along the X-direction. In other words, the movable housing 30A is displaced in the X-direction.

Referring to FIG. 29, each of the top plates 326A of the present embodiment has an end portion 327A and a regulation portion 328A which corresponds to the end portion 327A. Each of the end portions 327A is located at an inner end of the top plate 326A in the X-direction and faces the receiving portion 38A in the X-direction. Thus, each of the end portions 327A and the receiving portion 38A are adjacent to each other in the X-direction. Each of the regulation portions 328A extends downward from the corresponding end portion 327A. Each of the accommodated portions 48A has a regulated portion 482A corresponding to one of the regulation portions 328A. Under the separated state, each of the regulation portions 328A is located between the corresponding regulated portions 482A and the receiving portion 38A in the X-direction and regulates movements of the corresponding regulated portions 482A toward the receiving portion 38A.

In addition, according to the present embodiment, the additional facing portion 478A of each of the contacts 40A is located between the held portion 44 and the corresponding additional catching portion 324A of the movable housing 30A in the X-direction. In other words, each of the additional catching portions 324A is located inward of the corresponding additional facing portions 478A in the X-direction and regulates movements of the corresponding additional facing portions 478A toward the receiving portion 38A.

More specifically, referring to FIG. 29 together with FIG. 23, when the movable housing 30A is displaced in the X-direction, the regulated portion 482A of one of the two contacts 40A located at positions same as each other in the Y-direction, for example, the regulated portion 482A of the negative X-side contact 40A in FIGS. 23 and 29, is brought into contact with the corresponding regulation portion 328A of the movable housing 30A and is moved in the X-direction together with the regulation portion 328A. Even if the regulated portion 482A is moved downward and is not brought into contact with the regulation portion 328A, the additional facing portion 478A of each of the contacts 40A in one of the two rows in the X-direction, for example, the additional facing portion 478A of the negative X-side contact 40A in FIGS. 23 and 29, is reliably brought into contact with the corresponding additional catching portion 324A and is moved in the X-direction together with the additional catching portion 324A.

According to the present embodiment, the movement regulation by the regulation portions 328A and the additional catching portions 324A prevents the resiliently deformable portions 46A from being damaged. In detail, damage of the resiliently deformable portions 46A, which might occur when an upper end of the inner portion 466A of each of the resiliently deformable portions 46A is moved into the receiving portion 38A, is prevented. However, each of the regulation portions 328A and the additional catching portions 324A may be provided as necessary. For example, only the additional catching portions 324A may be provided while none of the regulation portions 328A is provided. Moreover, although each of the additional facing portions 478A of the present embodiment is apart from the corresponding additional catching portion 324A under the separated state, each of the additional facing portions 478A may be in contact with the corresponding additional catching portion 324A under the separated state. Thus, each of the additional facing portions 478A may be in contact with the corresponding additional catching portion 324A or may face the additional catching portion 324A at a distance apart therefrom in the X-direction.

Figure 22:
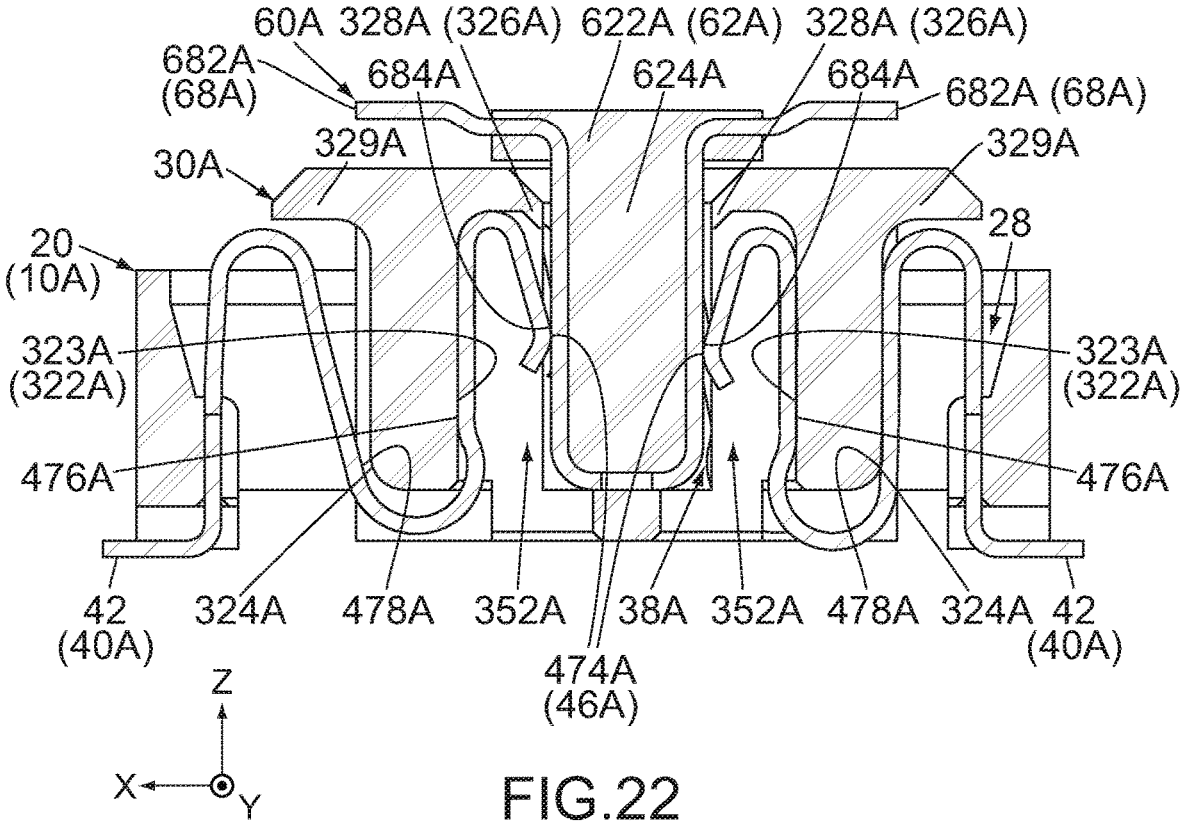
FIG. 22 is another cross-sectional view showing the connector and the mating connector of FIG. 21, wherein a movable housing of the connector is moved from the position shown in FIG. 21 along a width direction.

Referring to FIG. 22, according to the present embodiment, the resiliently deformable portion 46A of each of the contacts 40A in the one of the two rows in the X-direction, for example, the resiliently deformable portion 46A of the negative X-side contact 40A in FIG. 22, follows a movement of the movable housing 30A in the X-direction and is resiliently deformed so as to be compressed in the X-direction. As a result, when the connector 10A and the mating connector 60A are mated with each other under a state where the movable housing 30A is displaced in the X-direction, the contact portion 474A of each of the contacts 40A in the one of the two rows in the X-direction is brought into contact with the mating contact portion 684A of the corresponding mating contact 68A with sufficient contact pressure including a force toward its initial position.

Referring to FIG. 29, according to the present embodiment, each of the catching portions 323A of the movable housing 30A is located between the corresponding held portions 44 and the corresponding facing portions 476A in the X-direction. Referring to FIG. 23, according to this arrangement, when the movable housing 30A is moved along the X-direction, one of the catching portions 323A pushes the facing portion 476A of a remaining one of the two contacts 40A located at positions same as each other in the Y-direction, for example, the facing portion 476A of the positive X-side contact 40A in FIG. 23, inward in the X-direction.

More specifically, when the movable housing 30A is displaced in the X-direction, the facing portion 476A of the remaining one of the two contacts 40A located at positions same as each other in the Y-direction, for example, the facing portion 476A of the positive X-side contact 40A in FIG. 23, is moved in the X-direction while being pressed against the catching portion 323A of the movable housing 30A but being kept to be movable on the catching portion 323A. Referring to FIG. 22, this structure works to prevent decrease of the contact pressure at the contact portion 474A of each of the contacts 40A in a remaining one of the two rows in the X-direction, for example, at the contact portion 474A of the positive X-side contact 40A in FIG. 22. Thus, when the connector 10A and the mating connector 60A are mated with each other under the state where the movable housing 30A is displaced in the X-direction, the contact portion 474A of each of the contacts 40A in the remaining one of the two rows in the X-direction is also brought into contact with the mating contact portion 684A of the corresponding mating contact 68A with sufficient contact pressure.

According to the present embodiment, the facing portion 476A of each of the contacts 40A is kept to be movable at least in the Z-direction when pressed against the catching portion 323A in accordance with a relative movement of the movable housing 30A. In other words, a movement of the movable housing 30A relative to the fixed housing 20 enables the facing portions 476A to be pressed against the catching portion 323A while allowing movements of the facing portions 476A at least in the Z-direction.

According to the aforementioned structure, even in a case where the movable housing 30A is moved relative to the fixed housing 20, the resiliently deformable portion 46A keeps its spring characteristics, so that the contact portion 474A can be in contact with the mating contact 68A with sufficient contact pressure. The thus-formed single resiliently deformable portion 46A can be used both as a spring portion for floating and another spring portion for contact without fixing the contact 40A to the movable housing 30A, so that the size of the connector 10A, particularly the size thereof in the X-direction, can be reduced. Thus, the present embodiment similarly provides a new structure which enables reduction of the size of the floating connector.

In addition, referring to FIG. 29, according to the present embodiment, the movable housing 30A is, at least in part, accommodated in the housing-accommodation portion 28 of the fixed housing 20. In particular, the receiving portion 38A of the movable housing 30A is, at least in part, located in the housing-accommodation portion 28. According to this arrangement, the connector 10A can be reduced in size in the Z-direction.

According to the present embodiment, the facing portion 476A of each of the contacts 40A is in contact with the corresponding catching portion 323A under the separated state. However, the facing portion 476A of each of the contacts 40A may be apart from the corresponding catching portion 323A under the separated state, provided that the facing portion 476A is brought into abutment with and is caught by the corresponding catching portion 323A in accordance with a movement of the movable housing 30A relative to the fixed housing 20. Thus, each of the facing portions 476A may be in contact with the corresponding catching portion 323A or may face the corresponding catching portion 323A at a distance apart therefrom in the X-direction.

Referring to FIG. 23, according to the present embodiment, the facing portion 476A is a projection projecting outward in the X-direction, and the catching portion 323A is a planar portion. The facing portion 476A is movable on the catching portion 323A so as to slide thereon and is pivotable so as to change its inclination angle with respect to the catching portion 323A. In other words, the catching portion 323A is pivotable on the projection (facing portion 476A) and is movable on the facing portion 476A so as to slide thereon. This structure works to more reliably prevent decrease of the contact pressure at the contact portion 474A of each of the contacts 40A in the remaining one of the two rows in the X-direction, for example, the positive X-side contacts 40A in FIG. 22, even when the movable housing 30A is displaced in the X-direction.

However, the present invention is not limited to the aforementioned structure. For example, the catching portion 323A may be a projection. More specifically, a lower end corner (projection) of the inner surface 323A may work as a catching portion. According to this structure, an outer surface of a predetermined part of the resiliently deformable portion 46A in the X-direction may work as a facing portion. The predetermined part of the resiliently deformable portion 46A may be located inward of the projection in the X-direction and may extend to have a gentle arc shape. Thus, one of the facing portion 476A and the catching portion 323A may be a projection. Meanwhile, a remaining one of the facing portion 476A and the catching portion 323A may be pivotable on the projection and may be movable on the projection so as to slide thereon. Moreover, each of the facing portion 476A and the catching portion 323A may be a planar portion.

Referring to FIG. 29, according to the present embodiment, the movable housing 30A is provided with the two catching portions 323A and the two additional catching portions 324A. Referring to FIG. 27, each of the additional catching portions 324A extends continuously in the Y-direction so as to correspond to all of the contact-accommodation portions 352A of one of the two lows. In contrast, referring to FIG. 29 together with FIG. 27, each of the catching portions 323A extends in the Y-direction so as to correspond to all of the contact-accommodation portions 352A of one of the two lows while being divided by the partitions 354A. In other words, each of the catching portions 323A is a collection of a plurality of parts which are located in the contact-accommodation portions 352A, respectively. However, the present invention is not limited thereto. For example, each of the catching portions 323A may continuously extend in the Y-direction without being divided by the partitions 354A. Moreover, the movable housing 30A may be provided with only the two catching portions 323A or only the two additional catching portions 324A.

Referring to FIGS. 19 and 28, according to the present embodiment, while the mating connector 60A is mated with the connector 10A, the mating body portion 624A is received into the receiving portion 38A so that the mating housing 62A is positioned relative to the movable housing 30A in the XY-plane. Referring to FIG. 25, according to the present embodiment, adjacent two of the contacts 40A in the Y-direction are separated from each other by one of the partitions 354A so as to be prevented from being brought into contact with each other. In addition, while the mating connector 60A (see FIG. 19) is mated with the connector 10A, each of the contacts 40A is positioned relative to the corresponding mating contact 68A (see FIG. 19) by the partitions 354A and the end plates 321A.

Third Embodiment

Figure 30:
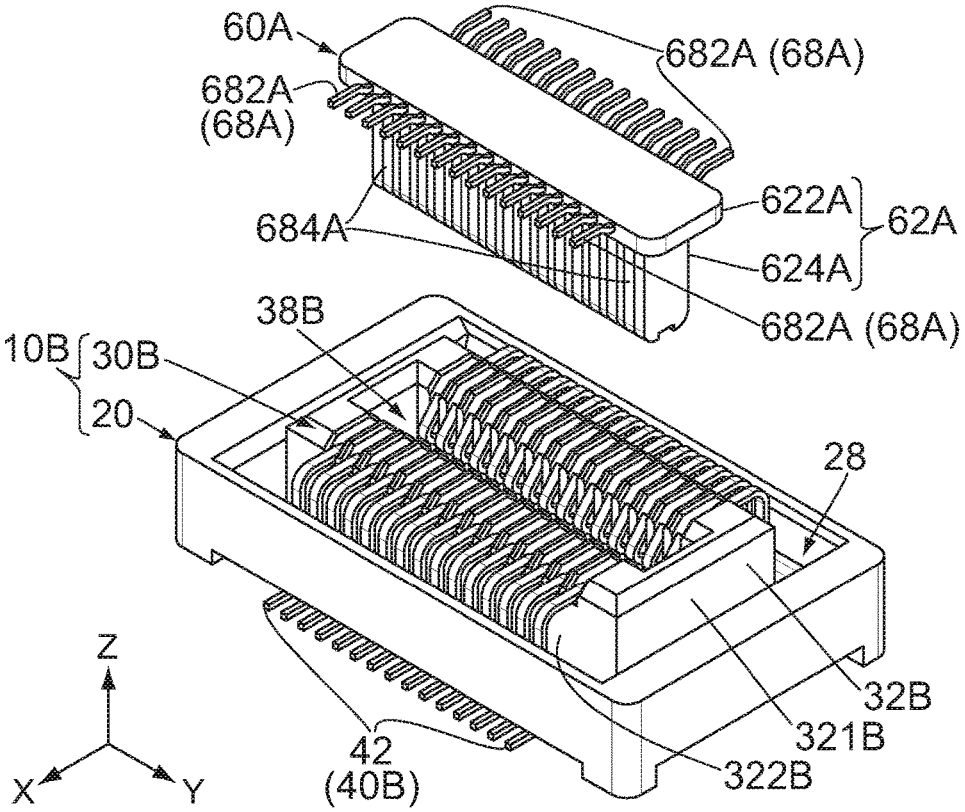
FIG. 30 is a perspective view showing a connector and a mating connector according to a third embodiment of the present invention, wherein the connector and the mating connector are separated from each other.
Figure 31:
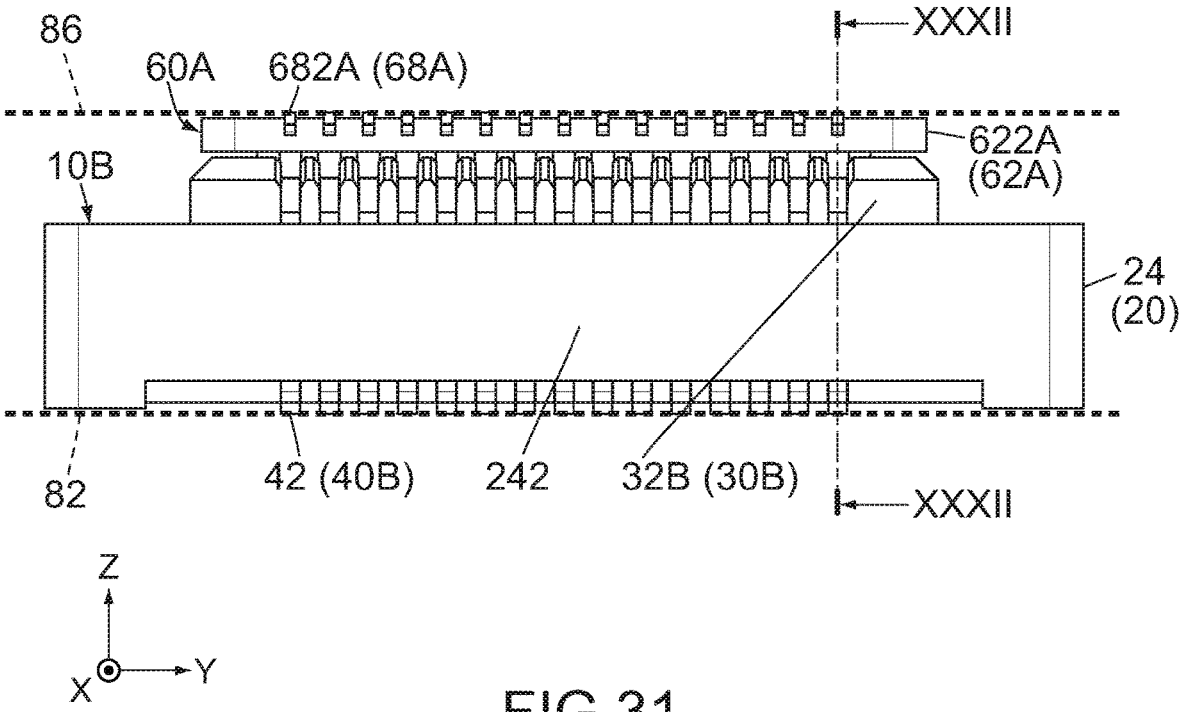
FIG. 31 is a side view showing the connector and the mating connector of FIG. 30, wherein the connector and the mating connector are mated with each other, and a part of a circuit board, on which the connector is mounted, and a part of a mating circuit board, on which the mating connector is mounted, are illustrated with dashed line.

Referring to FIGS. 30 and 31, a connector 10B according to the third embodiment of the present invention is mateable with the mating connector 60A along an upper-lower direction (Z-direction: mating direction) similarly to the connector 10A (see FIG. 19). The mating connector 60A mated with the connector 10B is removable from the connector 10B along the Z-direction. The connector 10B is a receptacle and is an on-board connector which is to be mounted on the circuit board 82.

Referring to FIGS. 30 and 35 to 37, the connector 10B comprises the fixed housing 20 same as that of the connector 10 (see FIG. 13), a movable housing 30B made of insulator and a plurality of contacts 40B each of which is made of conductor and which correspond to the mating contacts 68A, respectively. Hereafter, explanation will be made about the structure of each member of the connector 10B.

Figure 36:
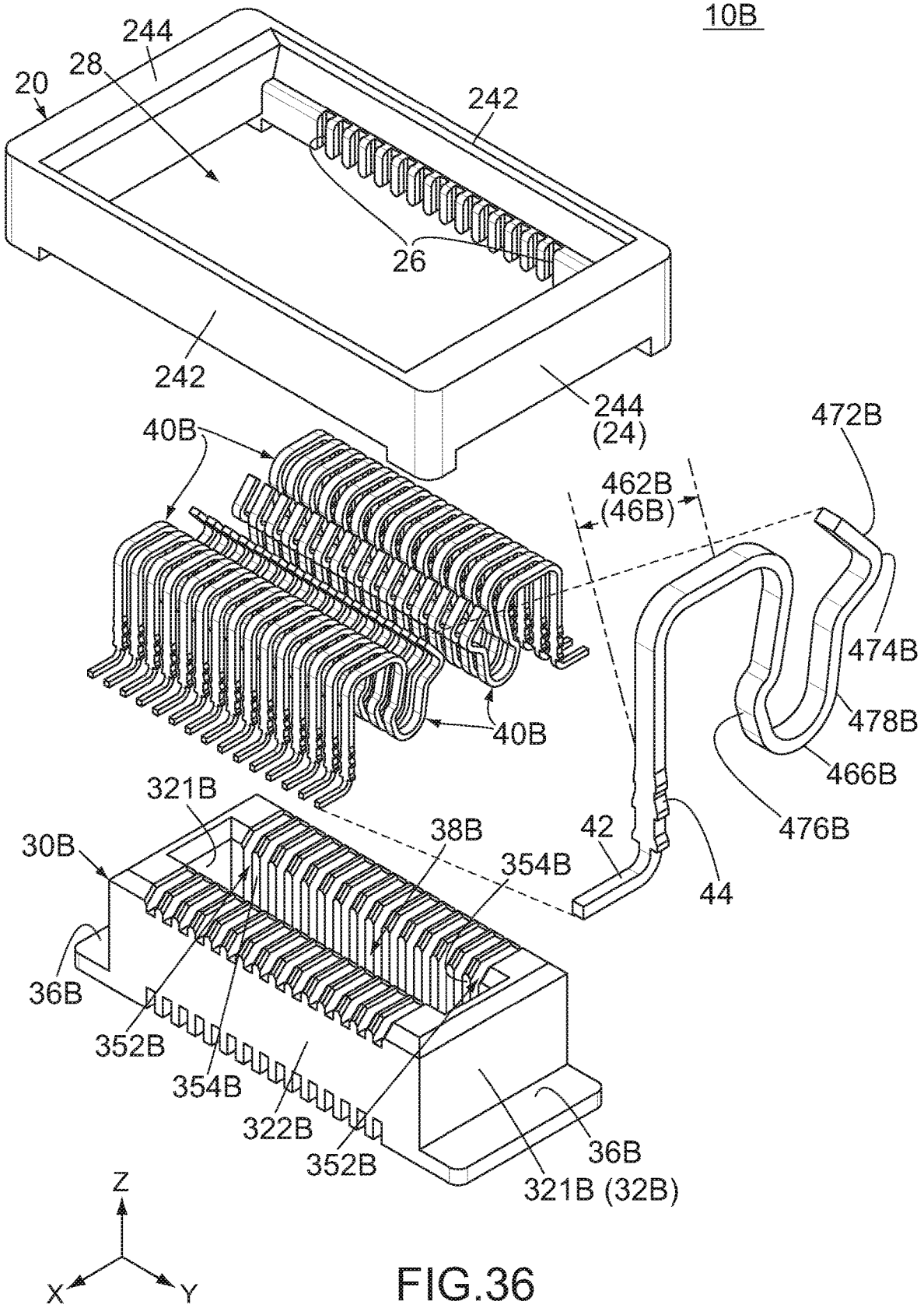
FIG. 36 is an exploded perspective view showing the connector of FIG. 30, wherein one of contacts is enlarged to be illustrated.
Figure 37:
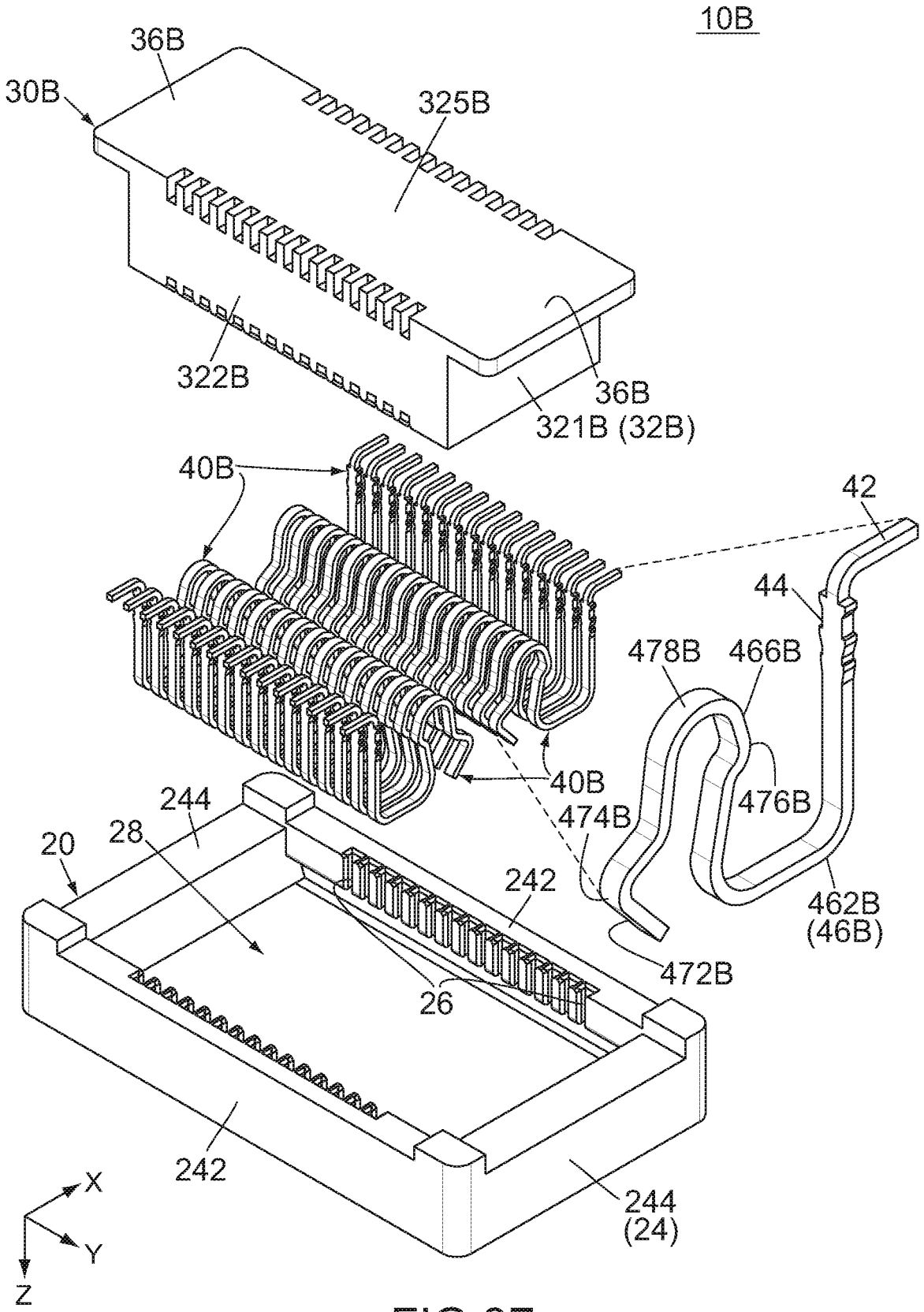
FIG. 37 is an exploded perspective view showing the connector of FIG. 35, wherein one of the contacts is enlarged to be illustrated.

Referring to FIG. 31, the fixed housing 20 is mounted on and fixed to the circuit board 82 when the connector 10B is used. Referring to FIGS. 36 and 37, the fixed housing 20 has the two coupling walls (movement restriction portions) 244, the housing-accommodation portion 28 which opens upward, or opens in the positive Z-direction, and the plurality of the holding portions 26 which correspond to the contacts 40B, respectively. The holding portions 26 are grouped into two rows in a width direction (X-direction) perpendicular to the Z-direction. The holding portions 26 of each row are arranged in a pitch direction (Y-direction) perpendicular to both the X-direction and the Z-direction.

Referring to FIGS. 30, 36 and 37, the movable housing 30B of the present embodiment has a body portion 32B and two flanges (restricted portions) 36B. The body portion 32B projects upward from a lower end, or the negative Z-side end, of the movable housing 30B and extends along the Y-direction. The flanges 36B are located at opposite sides of the movable housing 30B in the Y-direction, respectively. Each of the flanges 36B projects outward in the Y-direction from the lower end of the movable housing 30B and has a flat plate shape extending along a horizontal plane (XY-plane).

Referring to FIGS. 36 and 37, the body portion 32B has two end plates 321 B, two side plates 322B and a bottom plate 325B. Each of the end plates 321 B extends along the XZ-plane. Each of the side plates 322B extends along the YZ-plane. The bottom plate 325B is located at a lower end of the body portion 32B and extends all over the body portion 32B along the XY-plane.

Figure 39:
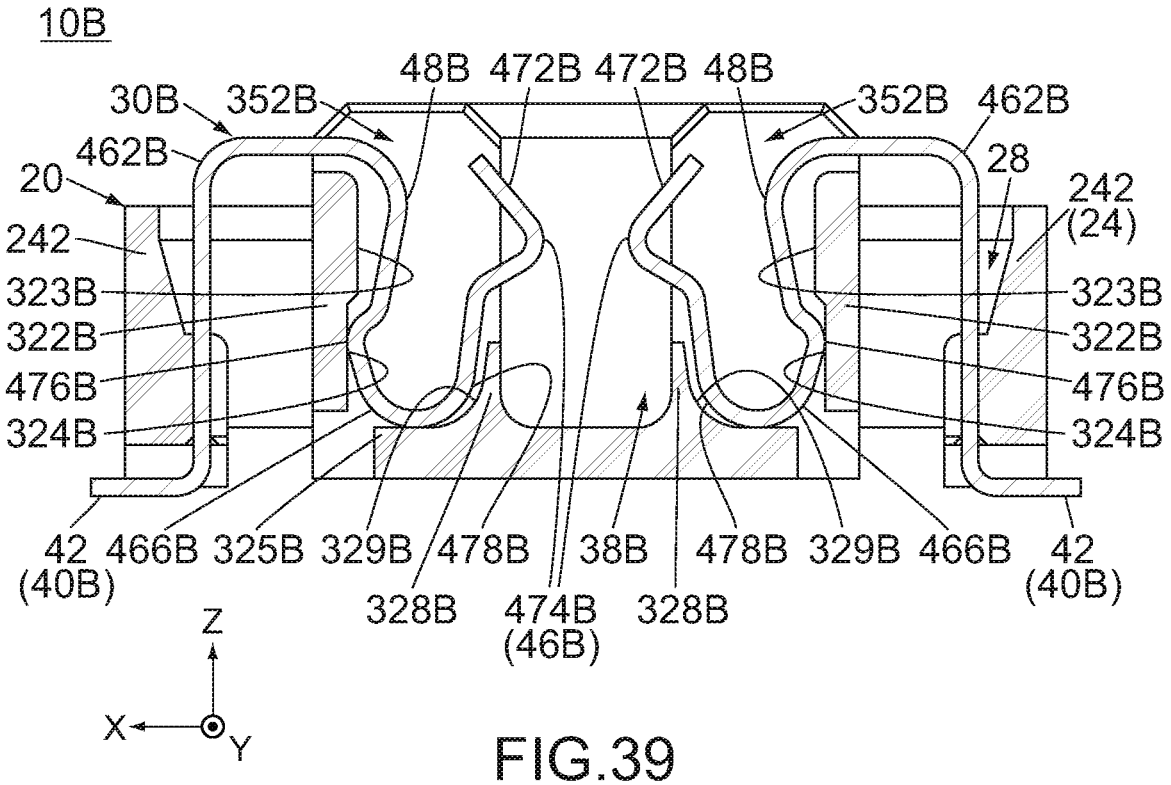
FIG. 39 is a cross-sectional view showing the connector of FIG. 38, taken along line XXXIX-XXXIX.
Figure 40:
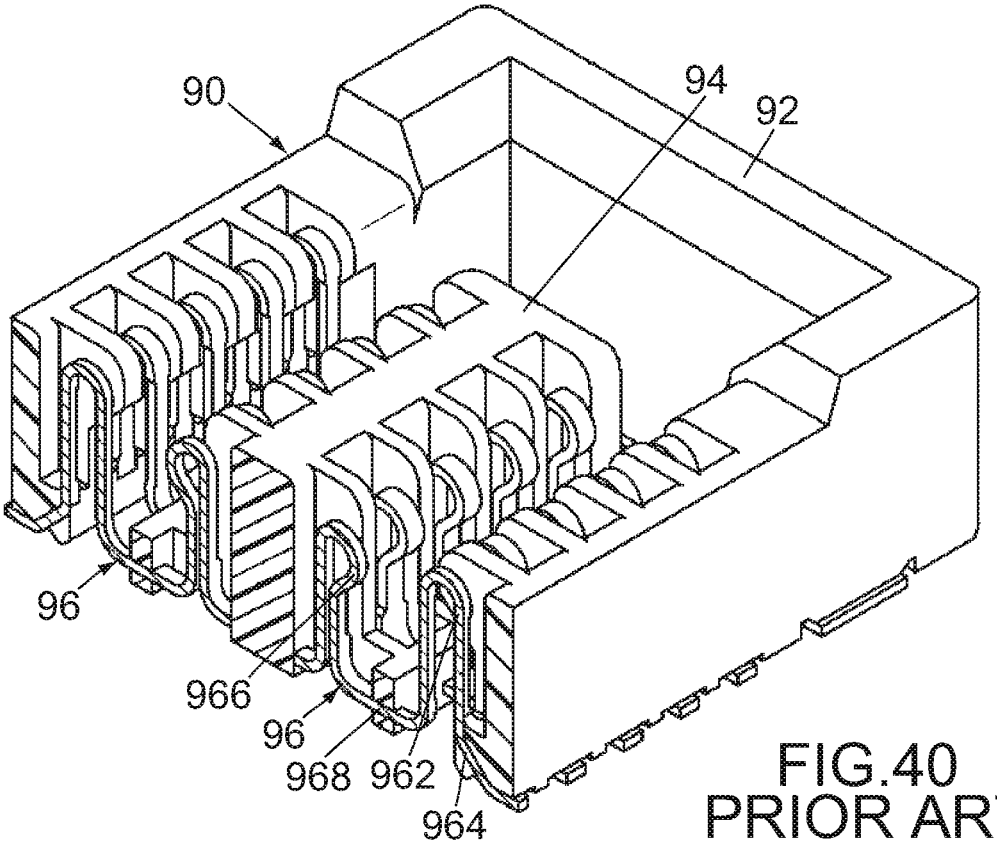
FIG.40 PRIOR ART
FIG. 40 is a partially cut-out perspective view showing a connector of Patent Document 1.

Referring to FIG. 39, each of the side plates 322B has an inner surface 323B which is an inner surface thereof in the X-direction. Each of the inner surfaces 323B has a lower part, or the negative Z-side part, which is recessed outward in the X-direction, so that a catching portion 324B is formed. Thus, each of the catching portions 324B is the lower part of the inner surface 323B and is recessed outward in the X-direction relative to an upper part, or the positive Z-side part, of the inner surface 323B. The bottom plate 325B is provided with projecting portions 328B which correspond to the side plates 322B, respectively. Each of the projecting portions 328B has an outer surface (additional catching portion) 329B. Each of the outer surfaces 329B is an outer surface of the projecting portion 328B in the X-direction and is a curved plane which is curved in the XZ-plane.

Figure 32:
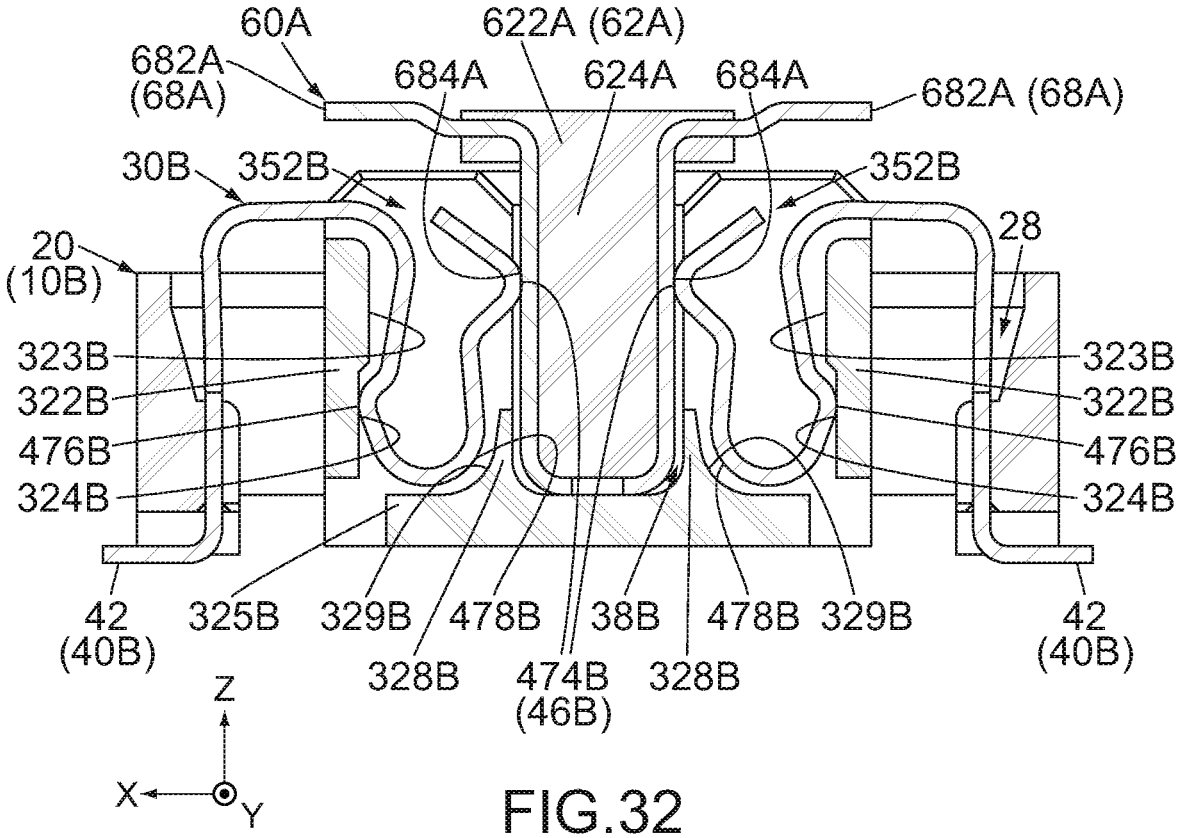
FIG. 32 is a cross-sectional view showing the connector and the mating connector of FIG. 31, taken along line XXXII-XXXII.
Figure 38:
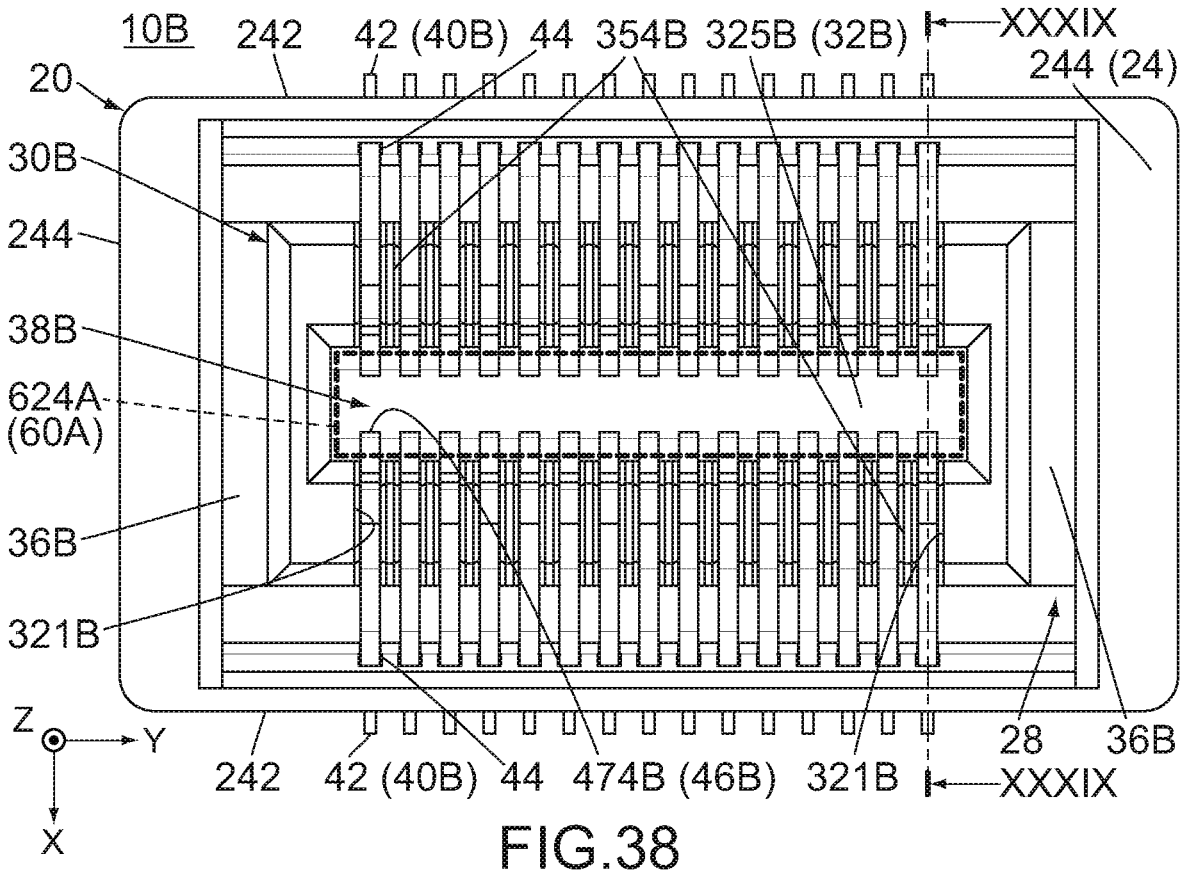
FIG. 38 is a plan view showing the connector of FIG. 30, wherein an outline of a mating body portion of the mating connector mated with the connector is illustrated with dashed line.

Referring to FIGS. 30, 36 and 38, the movable housing 30B has a single receiving portion 38B. The receiving portion 38B is a space which opens only upward. Referring to FIG. 32, similarly to the receiving portion 38A (see FIG. 21), the receiving portion 38B receives, at least in part, the mating connector 60A under a mated state where the connector 10B and the mating connector 60A are mated with each other.

As described above, the movable housing 30B of the present embodiment has the two catching portions 324B which correspond to the side plates 322B, respectively, the two outer surfaces (additional catching portions) 329B which correspond to the side plates 322B, respectively, the two flanges (restricted portions) 36B and the one receiving portion 38B.

Referring to FIGS. 36, the movable housing 30B has a plurality of contact-accommodation portions 352B which correspond to the contacts 40B, respectively, and one or more of partitions 354B.

Each of the contact-accommodation portions 352B is a space which opens upward. The contact-accommodation portions 352B are grouped into two rows in the X-direction. The two rows of the contact-accommodation portions 352B correspond to the two side plates 322B, respectively. The contact-accommodation portions 352B of each row have shapes same as one another and are arranged at regular intervals in the Y-direction. The two rows of the contact-accommodation portions 352B are arranged to be mirror images of each other with respect to the YZ-plane. Referring to FIGS. 36 and 39, each of the contact-accommodation portions 352B extends between the inner surface 323B of the corresponding side plate 322B and the receiving portion 38B in the X-direction while having a constant size in the Y-direction. Each of the contact-accommodation portions 352B communicates with the receiving portion 38B in the X-direction. Each of the partitions 354B is located between adjacent two of the contact-accommodation portions 352B in the Y-direction. Each of the partitions 354B extends between the inner surface 323B of the corresponding side plate 322B and the receiving portion 38B in the X-direction.

Referring to FIGS. 36 and 37, the contacts 40B have shapes same as one another and are grouped into two rows in the X-direction so as to correspond to the contact-accommodation portions 352B, respectively. The two rows of the contacts 40B are arranged to be mirror images of each other with respect to the YZ-plane. The contacts 40B of each row are arranged at regular intervals in the Y-direction.

Each of the contacts 40B is a single metal plate with bends and has a resiliently deformable portion 46B in addition to the fixed portion 42 which is to be fixed on the circuit board 82 (see FIG. 31) similarly to that of the contact 40 (see FIG. 13) and the held portion 44 which is to be held by the corresponding holding portion 26 similarly to that of the contact 40. The resiliently deformable portion 46B extends and meanders in the XZ-plane so that the resiliently deformable portion 46B is resiliently deformable. In detail, each of the resiliently deformable portions 46B has an outer portion 462B and an inner portion 466B. The outer portion 462B first extends upward from the upper end, or the positive Z-side end, of the held portion 44. Then, the outer portion 462B arcuately extends upward and inward in the X-direction and subsequently extends inward in the X-direction. The inner portion 466B first extends inward in the X-direction from an inner end of the outer portion 462B in the X-direction. Then, the inner portion 466B extends downward while partially protruding outward in the X-direction. Then, the inner portion 466B extends upward while partially protruding inward in the X-direction.

Each of the inner portions 466B has a guide portion 472B, a contact portion 474B, a facing portion 476B and an additional facing portion 478B. The guide portion 472B extends upward and outward in the X-direction.

Each of the facing portion 476B and the additional facing portion 478B is located between the held portion 44 and the contact portion 474B in the X-direction. The contact portion 474B and the facing portion 476B are located at positions different from each other in the Z-direction and face in opposite directions in the X-direction. In the present embodiment, the contact portion 474B faces inward in the X-direction, and the facing portion 476B faces outward in the X-direction. In other words, the contact portion 474B and the facing portion 476B protrude so as to apart from each other in the X-direction. In contrast, the contact portion 474B and the additional facing portion 478B face in the same direction, or in a common direction, in the X-direction. More specifically, the additional facing portion 478B is located at a position different from that of the contact portion 474B in the Z-direction and faces inward in the X-direction similarly to the contact portion 474B. Each of the resiliently deformable portions 46B of the present embodiment is provided with the contact portion 474B, the facing portion 476B and the additional facing portion 478B which are formed as described above.

Figure 35:
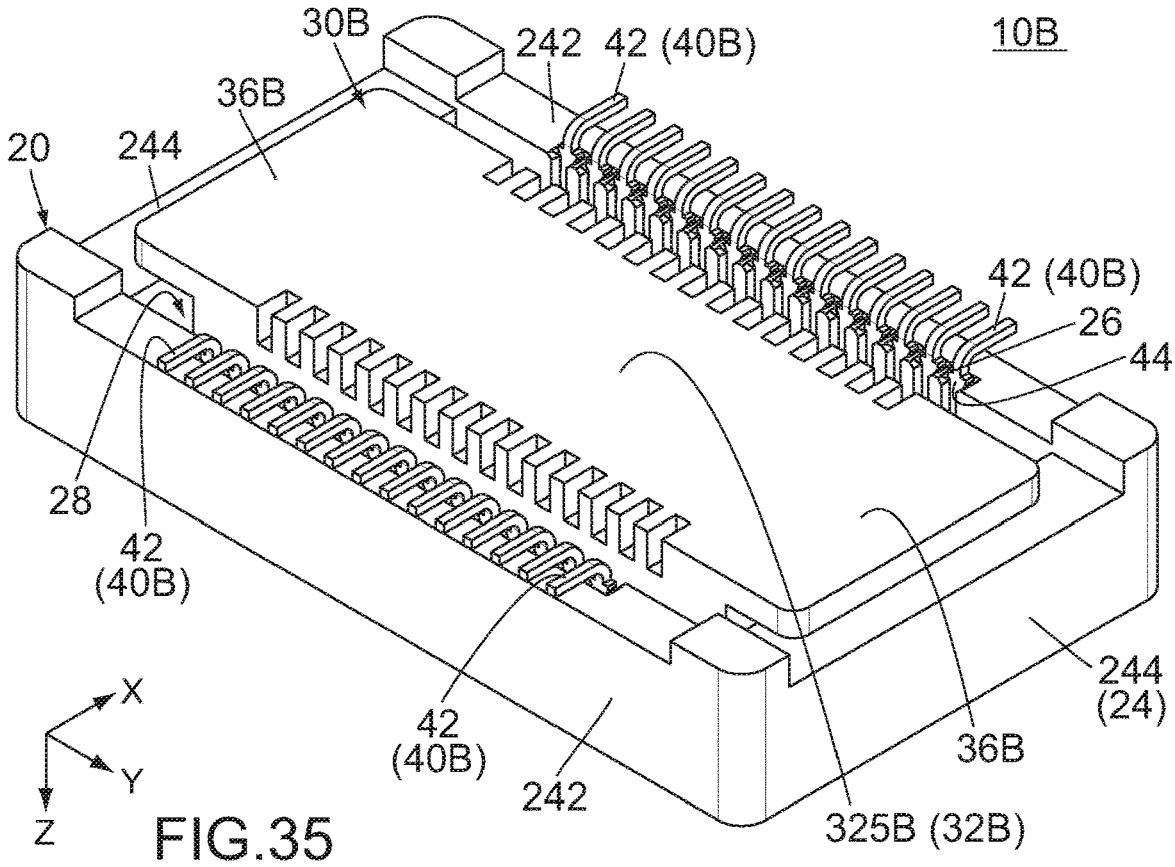
FIG. 35 is a perspective view showing the connector of FIG. 30.

Referring to FIGS. 35 to 37, in the present embodiment, the aforementioned members are combined as described below, so that the connector 10B is formed. First, each of the contacts 40B is attached to the fixed housing 20 from below. Then, the movable housing 30B is inserted into the housing-accommodation portion 28 of the fixed housing 20 from below.

Referring to FIGS. 39, when the movable housing 30B is inserted as described above, for each of the resiliently deformable portions 46B of the contacts 40B, the inner portion 466B is inserted and partially accommodated in the corresponding contact-accommodation portion 352B, and the outer portion 462B is arranged outward of the corresponding side plate 322B in the X-direction. As described above, the connector 10B of the present embodiment can be easily formed only by combining the contacts 40B and the movable housing 30B to the fixed housing 20 from below. Moreover, if the held portions 44 of the contacts 40B are embedded in and held by the fixed housing 20 via insert-molding, the connector 10B can be further easily formed only by combining the movable housing 30B to the fixed housing 20 from below.

Hereafter, explanation will be made about the structure of the connector 10B which is assembled as described above.

Referring to FIGS. 35, 38 and 39, in the XY-plane, a part of the movable housing 30B is located in the housing-accommodation portion 28 of the fixed housing 20 while being apart from the peripheral wall 24. In addition, referring to FIGS. 35 and 38, the two restricted portions 36B are located under and apart from the two movement restriction portions 244 of the fixed housing 20, respectively. The thus-arranged movable housing 30B is movable relative to the fixed housing 20 along the Z-direction and is movable relative to the fixed housing 20 along the XY-plane. Moreover, the movement restriction portions 244 are located above the restricted portions 36B, respectively, and restrict an upward movement of the movable housing 30B relative to the fixed housing 20 within a predetermined range. In addition, the peripheral wall 24 restricts another movement of the movable housing 30B relative to the fixed housing 20 along the XY-plane within another predetermined range. Thus, the connector 10B is a floating connector similar to the connector 10A (see FIG. 25).

Referring to FIG. 39, according to the present embodiment, each of the contacts 40B is held by and fixed to the fixed housing 20 only at the corresponding holding portion 26. Each of the contacts 40B has no part which is held by or fixed to the movable housing 30B. Each of the resiliently deformable portions 46B according to the present embodiment is, similarly to the resiliently deformable portion 46 (see FIG. 17), movable relative to the fixed housing 20 with no movement of the movable housing 30B relative to the fixed housing 20.

Each of the resiliently deformable portions 46B of the contacts 40B is, at least in part, accommodated in the corresponding contact-accommodation portion 352B under a separated state (see FIG. 30) where the connector 10B and the mating connector 60A (see FIG. 30) are separated from each other. In detail, each of the resiliently deformable portions 46B has an accommodated portion 48B. Each of the accommodated portions 48B is a part which is located in the corresponding contact-accommodation portion 352B under a state where any part and any member of the connector 10B are applied with no force except the force due to their own weights. In other words, each of the accommodated portions 48B is accommodated in the corresponding contact-accommodation portion 352B under the separated state shown in FIG. 39. Under the separated state, the contact portion 474B of each of the contacts 40B is located in the receiving portion 38B and is movable in the X-direction in accordance with resilient deformation of the resiliently deformable portion 46B.

Referring to FIG. 32, when the mating connector 60A is mated with the connector 10B without moving the movable housing 30B in the X-direction from the position under the separated state (see FIG. 39), the contact portion 474B of each of the contacts 40B is brought into contact with the mating contact portion 684A of the corresponding mating contact 68A with predetermined sufficient contact pressure. As a result, the connector 10B and the mating connector 60A are electrically connected with each other.

Referring to FIG. 32, according to the present embodiment, the facing portion 476B of each of the resiliently deformable portions 46B is brought into abutment with a step which is formed at an upper end of the corresponding catching portion 324B when moved upward in accordance with a removal of the mating connector 60A from the connector 10B. Therefore, each of the facing portions 476B cannot be moved upward beyond the upper end of the corresponding catching portion 324B. This structure of the present embodiment prevents damage of the contact 40B which might occur because of excessive resilient deformation of the resiliently deformable portion 46B.

Figure 34:
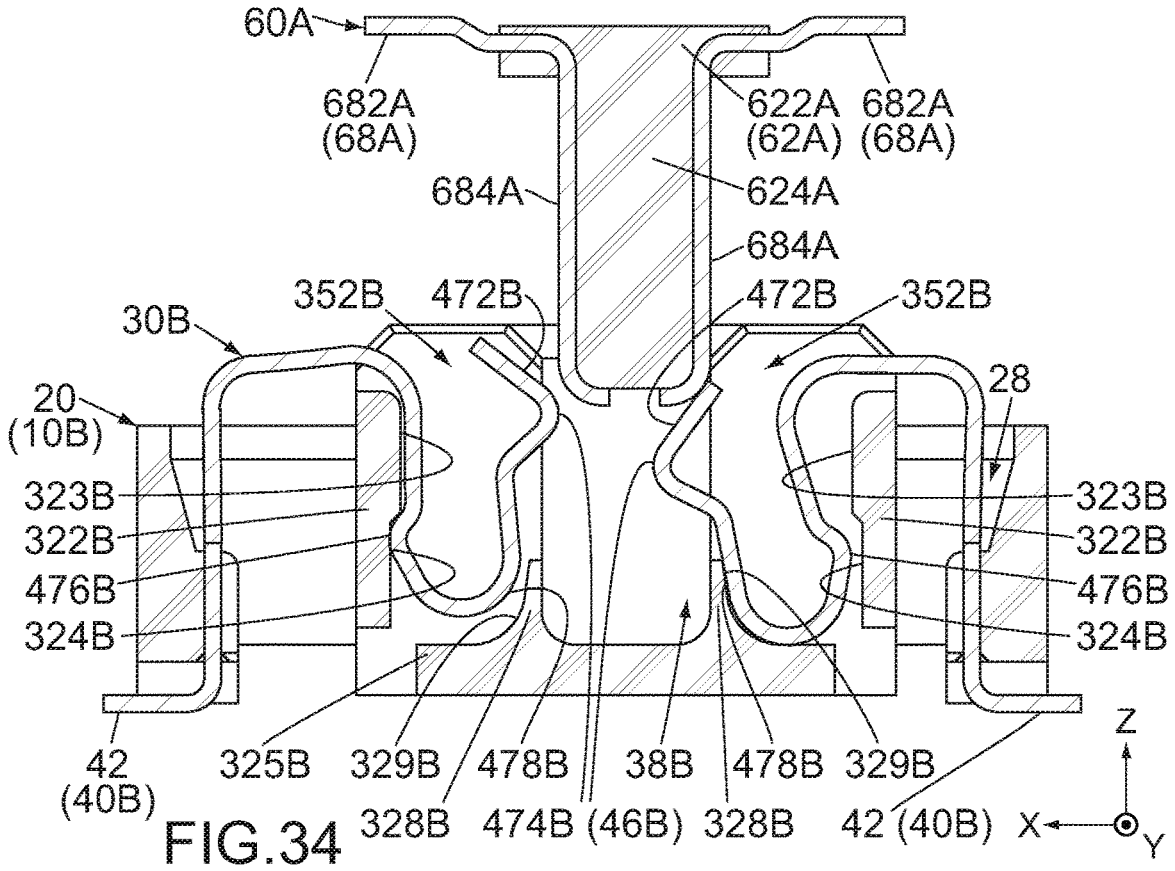
FIG. 34 is another cross-sectional view showing the connector and the mating connector of FIG. 33, wherein the connector is in a process of being mated with the mating connector.

Referring to FIG. 34, if the position of the mating connector 60A in the X-direction is shifted with respect to the middle position of the fixed housing 20 in the X-direction during a mating process of the mating connector 60A with the connector 10B, the mating connector 60A pushes the movable housing 30B along the X-direction, so that the movable housing 30B is moved relative to the fixed housing 20 along the X-direction. In other words, the movable housing 30B is displaced in the X-direction.

Referring to FIG. 39, according to the present embodiment, the additional facing portion 478B of each of the contacts 40B is located between the held portion 44 and the corresponding additional catching portion 329B of the movable housing 30B in the X-direction. In other words, each of the additional catching portions 329B is located inward of the corresponding additional facing portions 478B in the X-direction and regulates movements of the corresponding additional facing portions 478B toward the receiving portion 38B. More specifically, referring to FIG. 39 together with FIG. 34, when the movable housing 30B is displaced in the X-direction, the additional facing portion 478B of one of the two contacts 40B located at positions same as each other in the Y-direction, for example, the additional facing portion 478B of the negative X-side contact 40B in FIGS. 34 and 39, is brought into contact with the corresponding additional catching portion 329B and is moved in the X-direction together with the additional catching portion 329B.

According to the present embodiment, the movement regulation by the additional catching portions 329B prevents the resiliently deformable portions 46B from being damaged. In detail, damage of the resiliently deformable portions 46B, which might occur when an upper end of the inner portion 466B of each of the resiliently deformable portions 46B is moved into the receiving portion 38B, is prevented. However, the additional catching portions 329B may be provided as necessary. Moreover, although each of the additional facing portions 478B of the present embodiment is apart from the corresponding additional catching portion 329B under the separated state, each of the additional facing portions 478B may be in contact with the corresponding additional catching portion 329B under the separated state. Thus, each of the additional facing portions 478B may be in contact with the corresponding additional catching portion 329B or may face the additional catching portion 329B at a distance apart therefrom in the X-direction.

Figure 33:
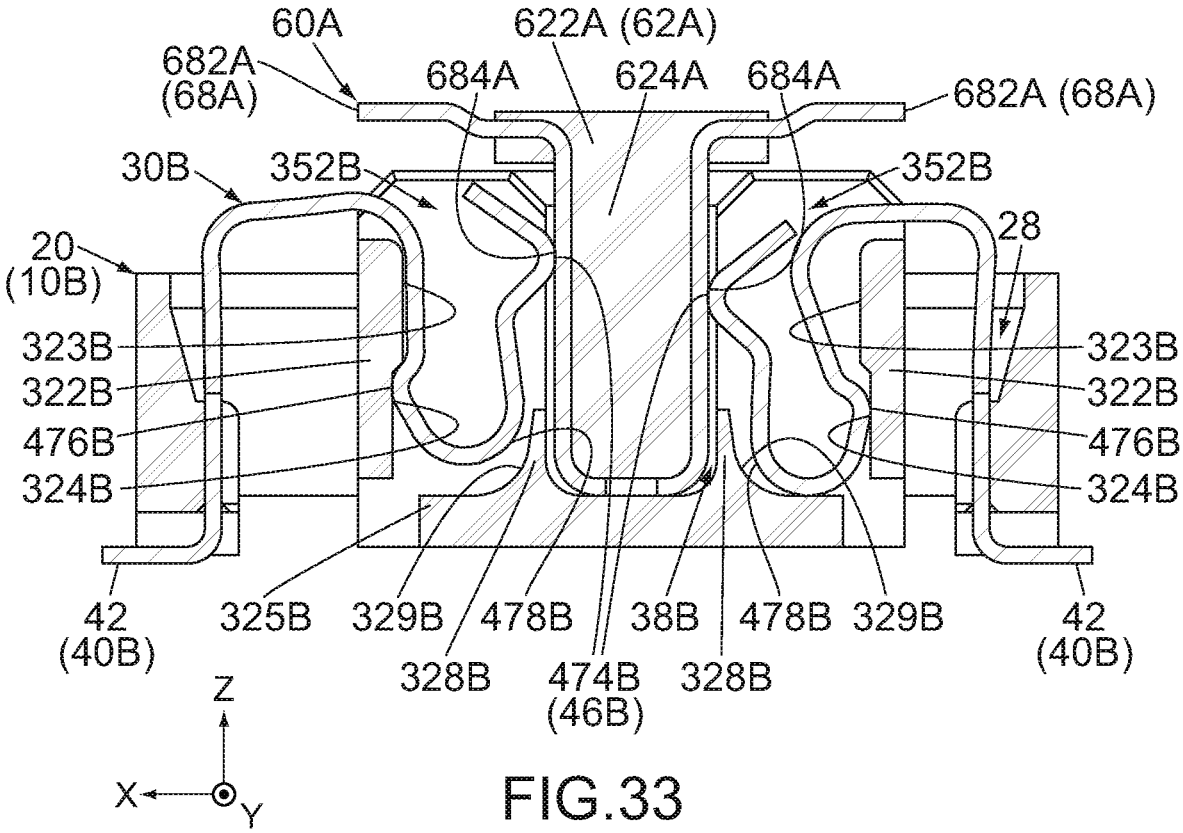
FIG. 33 is another cross-sectional view showing the connector and the mating connector of FIG. 32, wherein a movable housing of the connector is moved from the position shown in FIG. 32 along a width direction.

Referring to FIG. 33, according to the present embodiment, the resiliently deformable portion 46B of each of the contacts 40B in one of the two rows in the X-direction, for example, the resiliently deformable portion 46B of the negative X-side contact 40B in FIG. 33, follows a movement of the movable housing 30B in the X-direction and is resiliently deformed so as to be compressed in the X-direction. As a result, when the connector 10B and the mating connector 60A are mated with each other under a state where the movable housing 30B is displaced in the X-direction, the contact portion 474B of each of the contacts 40B in the one of the two rows in the X-direction is brought into contact with the mating contact portion 684A of the corresponding mating contact 68A with sufficient contact pressure including a force toward its initial position.

Referring to FIG. 39, according to the present embodiment, each of the catching portions 324B of the movable housing 30B is located between the corresponding held portions 44 and the corresponding facing portions 476B in the X-direction. Referring to FIG. 34, according to this arrangement, when the movable housing 30B is moved along the X-direction, one of the catching portions 324B pushes the facing portion 476B of a remaining one of the two contacts 40B located at positions same as each other in the Y-direction, for example, the facing portion 476B of the positive X-side contact 40B in FIG. 34, inward in the X-direction.

More specifically, when the movable housing 30B is displaced in the X-direction, the facing portion 476B of the remaining one of the two contacts 40B located at positions same as each other in the Y-direction, for example, the facing portion 476B of the positive X-side contact 40B in FIG. 34, is moved in the X-direction while being pressed against the catching portion 324B of the movable housing 30B but being kept to be movable on the catching portion 324B. Referring to FIG. 33, this structure works to prevent decrease of the contact pressure at the contact portion 474B of each of the contacts 40B in a remaining one of the two rows in the X-direction, for example, at the contact portion 474B of the positive X-side contact 40B in FIG. 33. Thus, when the connector 10B and the mating connector 60A are mated with each other under the state where the movable housing 30B is displaced in the X-direction, the contact portion 474B of each of the contacts 40B in the remaining one of the two rows in the X-direction is also brought into contact with the mating contact portion 684A of the corresponding mating contact 68A with sufficient contact pressure.

According to the present embodiment, the facing portion 476B of each of the contacts 40B is kept to be movable at least in the Z-direction when pressed against the catching portion 324B in accordance with a relative movement of the movable housing 30B. In other words, a movement of the movable housing 30B relative to the fixed housing 20 enables the facing portions 476B to be pressed against the catching portion 324B while allowing movements of the facing portions 476B at least in the Z-direction.

According to the aforementioned structure, even in a case where the movable housing 30B is moved relative to the fixed housing 20, the resiliently deformable portion 46B keeps its spring characteristics, so that the contact portion 474B can be in contact with the mating contact 68A with sufficient contact pressure. The thus-formed single resiliently deformable portion 46B can be used both as a spring portion for floating and another spring portion for contact without fixing the contact 40B to the movable housing 30B, so that the size of the connector 10B, particularly the size thereof in the X-direction, can be reduced. Thus, the present embodiment similarly provides a new structure which enables reduction of the size of the floating connector.

In addition, referring to FIG. 39, according to the present embodiment, the movable housing 30B is, at least in part, accommodated in the housing-accommodation portion 28 of the fixed housing 20. In particular, the receiving portion 38B of the movable housing 30B is, at least in part, located in the housing-accommodation portion 28. According to this arrangement, the connector 10B can be reduced in size in the Z-direction.

According to the present embodiment, the facing portion 476B of each of the contacts 40B is in contact with the corresponding catching portion 324B under the separated state. However, the facing portion 476B of each of the contacts 40B may be apart from the corresponding catching portion 324B under the separated state, provided that the facing portion 476B is brought into abutment with and is caught by the corresponding catching portion 324B in accordance with a movement of the movable housing 30B relative to the fixed housing 20. Thus, each of the facing portions 476B may be in contact with the corresponding catching portion 324B or may face the corresponding catching portion 324B at a distance apart therefrom in the X-direction.

Referring to FIG. 34, according to the present embodiment, the facing portion 476B is a projection projecting outward in the X-direction, and the catching portion 324B is a planar portion. The facing portion 476B is movable on the catching portion 324B so as to slide thereon and is pivotable so as to change its inclination angle with respect to the catching portion 324B. In other words, the catching portion 324B is pivotable on the projection (facing portion 476B) and is movable on the facing portion 476B so as to slide thereon. However, the present invention is not limited thereto. For example, the catching portion 324B may be a projection projecting inward in the X-direction, and the facing portion 476B may be a linearly extending portion. Thus, one of the facing portion 476B and the catching portion 324B may be a projection. According to this structure, a remaining one of the facing portion 476B and the catching portion 324B may be pivotable on the projection and may be movable on the projection so as to slide thereon. This structure works to more reliably prevent decrease of the contact pressure at the contact portion 474B of each of the contacts 40B in the remaining one of the two rows in the X-direction, for example, at the contact portion 474B of the positive X-side contact 40B in FIG. 34, even when the movable housing 30B is displaced in the X-direction.

Referring to FIG. 39, according to the present embodiment, the movable housing 30B is provided with the two catching portions 324B and the two additional catching portions 329B. Each of the catching portions 324B and the additional catching portions 329B is a collection of a plurality of parts which are located in the contact-accommodation portions 352B, respectively.

Referring to FIGS. 30 and 38, the receiving portion 38B according to the present embodiment can position the mating connector 60A similarly to the receiving portion 38A (see FIG. 28). In addition, referring to FIG. 38, similarly to the partitions 354A, each of the partitions 354B can prevent adjacent two of the contacts 40B in the Y-direction from being brought into contact with each other and can position each of the contacts 40B relative to the corresponding mating contact 68A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an upper-lower direction, wherein:

the connector comprises a fixed housing, a movable housing and a plurality of contacts;

the fixed housing has a housing-accommodation portion and a plurality of holding portions which correspond to the contacts, respectively;

the housing-accommodation portion opens upward;

the holding portions are arranged in a pitch direction perpendicular to the upper-lower direction;

the movable housing is, at least in part, accommodated in the housing-accommodation portion;

the movable housing is movable relative to the fixed housing along the upper-lower direction and is movable relative to the fixed housing along a horizontal plane perpendicular to the upper-lower direction;

the movable housing has a receiving portion, one or more partitions, a catching portion and a plurality of contact-accommodation portions which correspond to the contacts, respectively;

the receiving portion opens upward and receives, at least in part, the mating connector under a mated state where the connector and the mating connector are mated with each other;

the contact-accommodation portions are arranged in the pitch direction and communicate with the receiving portion in a width direction perpendicular to both the upper-lower direction and the pitch direction;

each of the partitions is located between adjacent two of the contact-accommodation portions in the pitch direction;

each of the contacts has a held portion and a resiliently deformable portion;

each of the held portions is held by a corresponding one of the holding portions;

each of the resiliently deformable portions is resiliently deformable and is, at least in part, accommodated in a corresponding one of the contact-accommodation portions under a separated state where the connector and the mating connector are separated from each other;

each of the resiliently deformable portions is provided with a contact portion and a facing portion;

each of the facing portions is located between the held portion and the contact portion in the width direction;

each of the facing portions is in contact with the catching portion or faces the catching portion at a distance apart therefrom in the width direction; and a movement of the movable housing relative to the fixed housing enables the facing portions to be pressed against the catching portion while allowing movements of the facing portions at least in the upper-lower direction.

2. The connector as recited in claim 1, wherein the contact portion and the facing portion of each of the contacts face in opposite directions in the width direction.

3. The connector as recited in claim 2, wherein each of the facing portions is located between the held portion and the catching portion in the width direction.

4. The connector as recited in claim 2, wherein the catching portion is located between the held portions and the facing portions in the width direction.

5. The connector as recited in claim 1, wherein one of the facing portion and the catching portion is a projection, and a remaining one of the facing portion and the catching portion is pivotable on the projection and is movable on the projection so as to slide thereon.

6. The connector as recited in claim 1, wherein:

the movable housing has an additional catching portion;

each of the resiliently deformable portions is provided with an additional facing portion;

the additional facing portions are in contact with the additional catching portion or face the additional catching portion at a distance apart therefrom in the width direction; and the contact portion and the additional facing portion of each of the contacts face the same direction in the width direction.

7. The connector as recited in claim 1, wherein:

the fixed housing has a movement restriction portion;

the movable housing has a restricted portion; and the movement restriction portion is located above the restricted portion and restricts an upward movement of the movable housing relative to the fixed housing within a predetermined range.

8. The connector as recited in claim 1, wherein:

each of the resiliently deformable portions has an accommodated portion; and each of the accommodated portions is accommodated in a corresponding one of the contact-accommodation portions under the separated state.

9. The connector as recited in claim 8, wherein:

the movable housing has a regulation portion;

each of the accommodated portions has a regulated portion; and under the separated state, the regulation portion is located between the regulated portions and the receiving portion in the width direction and regulates movements of the regulated portions toward the receiving portion.

10. The connector as recited in claim 8, wherein:

the movable housing has a top plate; and each of the accommodated portions is, at least in part, located right under the top plate.

11. The connector as recited in claim 10, wherein:

the top plate has an end portion and a regulation portion;

the end portion and the receiving portion are adjacent to each other in the width direction;

the regulation portion extends downward from the end portion;

each of the accommodated portions has a regulated portion; and under the separated state, the regulation portion is located between the regulated portions and the receiving portion in the width direction and regulates movements of the regulated portions toward the receiving portion.

12. The connector as recited in claim 10, wherein:

the movable housing has an additional top plate; and each of the resiliently deformable portions is partially located right under the additional top plate.

13. The connector as recited in claim 1, wherein the receiving portion is, at least in part, located in the housing-accommodation portion.

14. The connector as recited in claim 1, wherein each of the resiliently deformable portions is movable relative to the fixed housing with no movement of the movable housing relative to the fixed housing.

15. The connector as recited in claim 1, wherein the movable housing is movable relative to the fixed housing with no movement of each of the resiliently deformable portions relative to the fixed housing.

* * * * *